US006474116B1

(12) United States Patent
Lai

(10) Patent No.: US 6,474,116 B1
(45) **Date of Patent: *Nov. 5, 2002**

(54) COMBINATION LOCK WITH DUAL LOCKING MEANS

(75) Inventor: Eric Lai, Sheung Shui (HK)

(73) Assignee: The Sun Lock Company Ltd., Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 09/492,022

(22) Filed: Jan. 26, 2000

Related U.S. Application Data

(63) Continuation-in-part of application No. 09/219,911, filed on Dec. 23, 1998, now Pat. No. 6,035,672.

(51) Int. Cl.[7] ..... E05B 37/06; E05B 37/10; E05B 37/18; E05B 37/22

(52) U.S. Cl. ..... 70/25; 70/233

(58) Field of Search ..... 70/25, 233, 312, 70/315

(56) References Cited

U.S. PATENT DOCUMENTS 3,906,758 A * 9/1975 Hurwitt ..... 70/30
4,733,548 A * 3/1988 Ling ..... 70/25
5,408,212 A * 4/1995 Meyers et al. ..... 340/427
5,560,232 A * 10/1996 Chen ..... 70/30
5,706,679 A * 1/1998 Zane et al. ..... 70/18
5,715,709 A * 2/1998 Lai ..... 70/25
5,960,652 A * 10/1999 Marmstad ..... 70/49
6,035,672 A * 3/2000 Lai ..... 70/25
6,058,744 A * 5/2000 Ling ..... 70/28
6,191,685 B1 * 2/2001 Theofanous et al. ..... 340/432

* cited by examiner

*Primary Examiner*—Anthony Knight
*Assistant Examiner*—John B. Walsh
(74) *Attorney, Agent, or Firm*—Melvin I. Stoltz

(57) ABSTRACT

By employing the present invention, a combination lock is achieved which provides two separate and independent locking members formed in a single combination lock. Preferably, the combination lock of the present invention incorporates, either independently or in combination with a visual indicator, two separate and independent locking members, such as a shackle and/or flexible cable member. In the preferred construction, the elongated flexible cable member is anchored at one end thereof to the housing of the padlock, with the opposed end being removably lockable to the housing. By employing a portion of the shackle as a locking component for the elongated flexible cable, the rotatable dials associated with the combination lock are employed for locking and unlocking both the shackle and the flexible cable. By achieving a combination lock having this unique, dual locking member, the user is provided with a greater sense of security and enhanced protection.

19 Claims, 13 Drawing Sheets

COMBINATION LOCK WITH DUAL LOCKING MEANS

RELATED APPLICATIONS

This application is a Continuation-in-Part Application of U.S. patent application Ser. No. 09/219,911, filed Dec. 23, 1998 now U.S. Pat. No. 6,035,672 Combination Padlock Construction With Positive Visual Indicator.

TECHNICAL FIELD

This invention relates to combination locks, and, more particularly, to combination locks constructed to provide two separate and independent locking members or zones.

BACKGROUND ART

Numerous lock constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, comprising the combination for releasing the lock. Typically, the combination lock has one mode or position in which the user is able to set or reset the desired combination sequence. Although locks of this general nature have been available for several decades, these prior art combination lock constructions suffer from common deficiencies which have not been successfully overcome.

Although many manufacturers have attempted to solve the problems associated with rotatable dial or combination locks, these prior art constructions have been unable to produce a construction which provides a unique visual display or indicator to the user when the lock is in its combination set or re-set position. As a result, combinations can be accidentally or inadvertently changed without the user becoming aware of the new combination.

A further problem typically found in prior art combination lock constructions is the presence of a single shackle or locking member. Typically, a generally J-shaped shackle is employed which is fixed in size and dimensions. As a result, the shackle is capable of securely locking only specifically sized products and is incapable of being employed for products which are not able to fit within the dimensional limitations of the shackle.

In an attempt to eliminate this particular problem, some prior art combination locks have been constructed employing flexible cables as the locking means. Although the flexible cables employed in these prior art structures do enable products of varying dimensions to be securely locked, these combination locks are limited by the length of the cable, as well as limited by incorporating a single locking member.

As a result, a user is required to select different lock constructions depending upon the particular items the user desires to secure. This requires users to possess a wide variety of combination locks, each of which incorporate a different locking member in order to be capable of satisfying all needs of the user.

In addition, another problem prior art combination locks have been unable to provide is a construction which eliminates the ability of unauthorized persons discovering the combination for opening the lock. Although numerous attempts have been made in prior art constructions for achieving a system which would eliminate or prevent these problems, these prior art constructions have failed to provide the desired results.

Another common problem which has consistently plagued prior art constructions is the cost of construction for producing and assembling prior art combination locks. In order to attain a combination lock which provides all of the features desired by consumers, prior art constructions typically incorporate numerous small components, each of which require expensive assembly procedures to produce the final product. As a result, these prior art lock constructions typically are expensive to produce, thereby reducing the ability of these locks to reach a broad base of consumers.

Another problem commonly found with prior art combination locks is the inability of these prior art constructions to prevent contaminants from reaching the rotatable, internal components of the lock, thereby causing damage to these components or interfering with the ease of operating the lock by an individual knowing the actual combination. Although numerous attempts have been made to reduce the adverse effects caused by contaminants reaching these components, such attempts have been incapable of satisfactorily eliminating this problem.

Therefore, it is a principal object of the present invention to provide a combination lock construction which provides an automatically generated, positive visual indicator whenever the lock is placed in its combination set or reset position.

Another object of the present invention is to provide a combination lock construction having the characteristic features described above which virtually eliminates the ability of unauthorized persons from gaining access to the lock by attempting to pick the lock using known techniques.

Another object of the present invention is to provide a combination lock construction having the characteristic features described above wherein the visual indicator remains displayed throughout the combination setting/re-setting function, disappearing only when the user has successfully completed the setting function.

Another object of the present invention is to provide a combination lock construction having the characteristic features described above which incorporates two separate and independent locking members, constructed for securely locking virtually all typical products by employing at least one of the locking members.

Another object of the present invention is to provide a combination lock construction having the characteristic features described above wherein both locking members operate using the same combination lock assembly, thereby providing flexibility as well as ease of construction and assembly.

Another object of the present invention is to provide a combination lock construction having the characteristic features described above wherein the visual indicator is prominently displayed in an easily seen and readily recognized manner.

Another object of the present invention is to provide a combination lock having the characteristic features described above which employs a minimum of components and is quickly and easily assembled, thereby providing a lock capable of being constructed at a competitive price.

Another object of the present invention is to provide a combination lock construction having the characteristic features described above which effectively seals the rotating components from external contamination and effectively prevents any external contaminants from reaching the rotating components thereof.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, combination lock is achieved which provides a positive visual indicator each time the combination lock is placed in its combination set or re-set position, and/or two separate and independent locking members formed in a single combination lock. In one embodiment, the visual indicator is automatically displayed upon entry of the lock into its combination setting or re-setting position in order to provide the user with a positive, readily seen, visual display clearly informing the user that the combination sequence may be altered. In an alternate embodiment, the combination lock of the present invention incorporates, either independently or in combination with the visual indicator, two separate and independent locking members, such as a shackle and/or flexible cable member.

In the visual display embodiment, a portion of the shackle is employed as the positive visual indicator. In this preferred construction, a section of the shackle extends from the base of the combination lock whenever the shackle is moved into its combination setting or re-setting position. In addition, this shackle extension portion remains in this protruding position during the setting/re-setting operation. However, upon removal of this shackle from the combination changing position, the visually indicating extension portion is withdrawn into the housing showing the user that the new combination has been successfully entered into the lock.

By achieving a combination lock having this unique visual indicator display system, accidental or inadvertent changes to the combination are virtually eliminated. In addition, by providing users with a readily seen, highly visable visual indicator, the user has a greater sense of security in frequently changing the combination, thereby enhancing the protection afforded by the combination lock. In this way, the combination lock of the present invention is capable of virtually eliminating the ability of unauthorized persons from opening the lock, using known techniques for discovering the combination.

In the alternate preferred embodiment, the combination lock of the present invention incorporates two separate and independent locking members, preferably a conventional shackle in combination with an elongated, flexible cable member or locking wire. In the preferred construction, the elongated flexible cable member is anchored at one end thereof to the housing of the padlock.

Preferably, the lockable end of the flexible cable is constructed for cooperative association with a portion of the shackle, enabling the cable member to be alternately moved into locked engagement or disengagement with the housing of the padlock, as desired by the user. In addition, by employing a portion of the shackle as a locking component for the elongated flexible cable, the rotatable dials associated with the combination lock are employed for locking and unlocking both the shackle and the flexible cable.

If desired, the combination padlock of the present invention which incorporates two separate and independent locking members may also incorporate the readily seen, highly visible visual indicator of this invention. However, if desired, these unique components can be employed in the padlock separately, without departing from the scope of this invention.

As fully detailed below, a plurality of alternate constructions and configurations can be employed for enabling the elongated, flexible cable to form an independent locking member of the combination padlock of the present invention. Preferably, each of these alternate constructions employs the shaft or other portion of the shackle as a component in the cable locking system. However, alternate locking structures or systems can be employed without departing from the scope of the present invention.

Furthermore, the lock constructions of the present invention are constructed with the interior chambers thereof virtually sealed from ambient surroundings, thereby preventing unwanted contamination from entering the interior of the lock and the rotating components thereof. In this way, the prior art degradation and interference of the lock operation by contamination is virtually eliminated.

In accordance with the present invention, a minimum number of components are employed in combination with a housing and a movable shackle in order to provide the desired, unique combination lock construction of this invention. In general, in addition to the shackle and housing, only a plurality of rotating dials and a plurality of tumbler sleeves are required to provide the desired locking mechanism. Preferably, in order to assure user security that a locked item remains locked and incapable of access by unauthorized personnel, four dials and tumbler sleeves are employed with the housing.

In the preferred construction, the central housing of the combination lock of this invention incorporates an elongated lock release groove or slot which provides the lock release zone for each of the independent rotatable tumbler sleeves. Furthermore, the shackle operates in direct association with these components to provide a reliable, secure lock construction, having the automatically displayed visual indicator detailed above.

In addition, in the preferred construction, all of the rotatable components are mounted in a single elongated bore formed in the housing and a sealing cap is employed to effectively close and seal the elongated bore once the components are mounted therein. As a result, ease of assembly is attained and, once assembly is completed, the elongated bore and the rotational components positioned therein are effectively sealed from external contamination. As a result, dirt, dust, debris, etc., commonly present in the environment, is eliminated from contaminating the working components of the combination lock of this invention. In this way, contamination from environmental sources which has often caused prior art lock assemblies to become defective or injured is effectively overcome.

In addition to these features, the present invention achieves a combination lock using a minimum number of independent components each of which is capable of being quickly assembled into the final product. As a result, a construction is attained which is capable of being manufactured at a competitive price, while providing a high quality, highly effective combination lock which prevents exposure to environmental contamination and also incorporates means for virtually eliminating unauthorized persons from opening the lock without knowledge of the combination.

The invention accordingly comprises an article of manufacture possessing the features, properties, and the relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
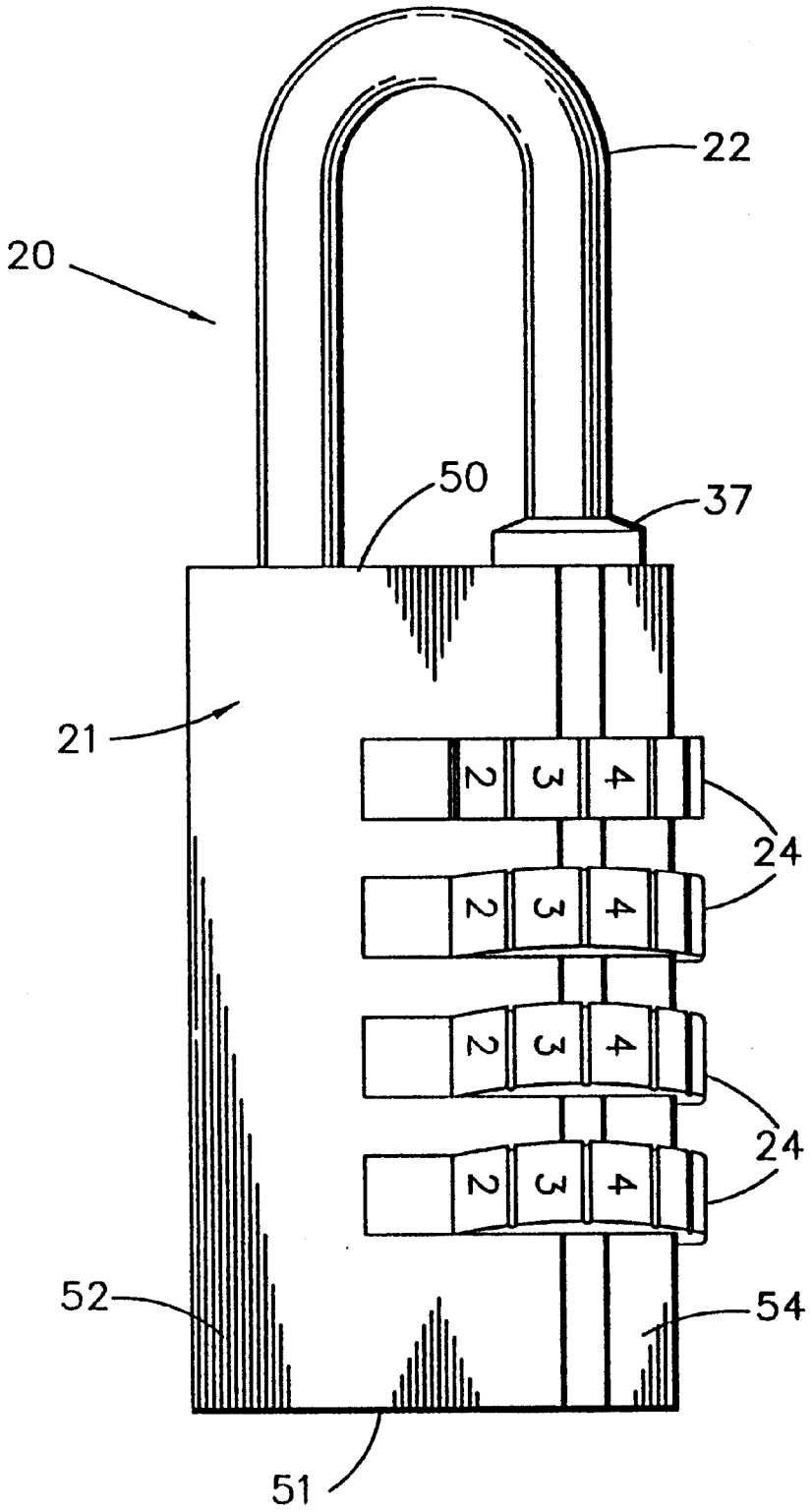
FIG. 1 is a perspective view of the combination lock of the present invention shown fully assembled and in the locked position.

By referring to FIGS. 1–21, along with the following detailed disclosure, the construction and operation of combination lock 20 of the present invention can best be understood. In the drawings and the following detailed disclosure, the preferred embodiment of the present invention is fully disclosed. However, the present invention can be implemented using alternate constructions, which alternate constructions are intended to be within the scope of the present invention.

As shown in FIGS. 1–21, combination lock 20 of the present invention is constructed using a minimum of principal components, thereby substantially reducing the complexity found in most prior art combination locks. In this way, the present invention provides a highly effective, commercially desirable construction capable of being produced at a competitive cost, while providing the unique attributes of the present invention and all of the locking and theft deterrent features typically incorporated in prior art combination locks.

In the present invention, the principal components comprise a central housing 21, a shackle 22, four separate and independent tumbler sleeve 23, and four separate and independent rotatable dials 24. By constructing and employing these principal components, in the unique manner detailed herein, an easily produced, highly effective combination lock 20 is attained.

Each tumbler sleeve 23 comprises a generally cylindrical shape incorporating a single locking fin 25 radially extending from outer, circular-shaped surface 26. In addition, each tumbler sleeve 23 also comprises an inside, circular-shaped surface 27 which is coaxially aligned with outside surface 26. The diameter of inside surface 27 of tumbler sleeve 23 is constructed to enable each tumbler sleeve 23 to freely pivot about the outer surface of shackle 22.

Each dial 24 is constructed for peripherally surrounding and cooperating with a tumbler sleeve 23. In this regard, each dial 24 comprises two separate and distinct, circular-shaped inside surfaces 28 and 29. In side surface 28 comprises a diameter slightly greater than the diameter of outside surface 26 of tumbler sleeve 23, in order to enable tumbler sleeve 23 and dial 24 to cooperate with each other while being independently rotationally movable about shackle 22.

In addition, each dial 24 comprises a plurality of slots 30 formed in inside surface 28, with each slot being constructed for receiving and retaining radially extending fin 25 of tumbler sleeve 23. In this way, whenever radially extending fin 25 is mounted in a slot 30 of dial 24, tumbler sleeve 23 and dial 24 are in interlocked engagement, causing both members to rotate together about shackle 22.

The number of slots 30 formed in dial 24 corresponds to the number of separate and distinct indicia formed on the outer surface of dial 24. In the preferred embodiment, ten indicia are employed on the outside surface of dial 24 and ten slots 30 are formed in surface 38.

Inside surface 29 of dial 24 comprises a circular shape formed by a diameter which is aligned with the axis of surface 28, but is greater than the length of fin 25. In this way, when fin 25 is disengaged from slot 30 of dial 24, dial 24 is able to rotate about shackle 22 independently of tumbler sleeve 23.

One of the principal elements of the present invention is schackle 22. In this preferred embodiment, shackle 22 comprises a conventional j-shape incorporating a short leg 31 with a terminating end 32 and a long leg 33 having a terminating end portion or section 34. Each tumbler sleeve 23 is rotationally mounted to leg 33 of shackle 22, with each tumbler sleeve having a dial 24 rotationally associated therewith. As fully detailed below, terminating end section 34 cooperates with housing 21 to provide the desired readily visible, automatically displayed, positive visual indicator whenever combination lock 20 is placed in the combination setting or re-setting position.

As discussed above, each dial 24 has a plurality of indicia formed on the outer peripheral surface thereof, each of which represents one component of the combination for positioning tumbler sleeves 23 in the requisite location for releasing shackle 22. Although any desired indicia can be employed, numerals or letters are typically employed on prior art constructions. In the present invention, each dial 24 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 24 is then employed to define the combination for lock 20.

The remaining components employed to form combination lock 20 of the present invention comprise washer 35, split locking ring 36, sealing cap 37, and spacer 43. In the preferred construction, leg 33 of shackle 22 incorporates ribs 38 and 39 formed on the outer surface thereof and a locking ring receiving slot 40 formed directly adjacent terminating end section 34 of leg 33 of shackle 22.

Figure 2:
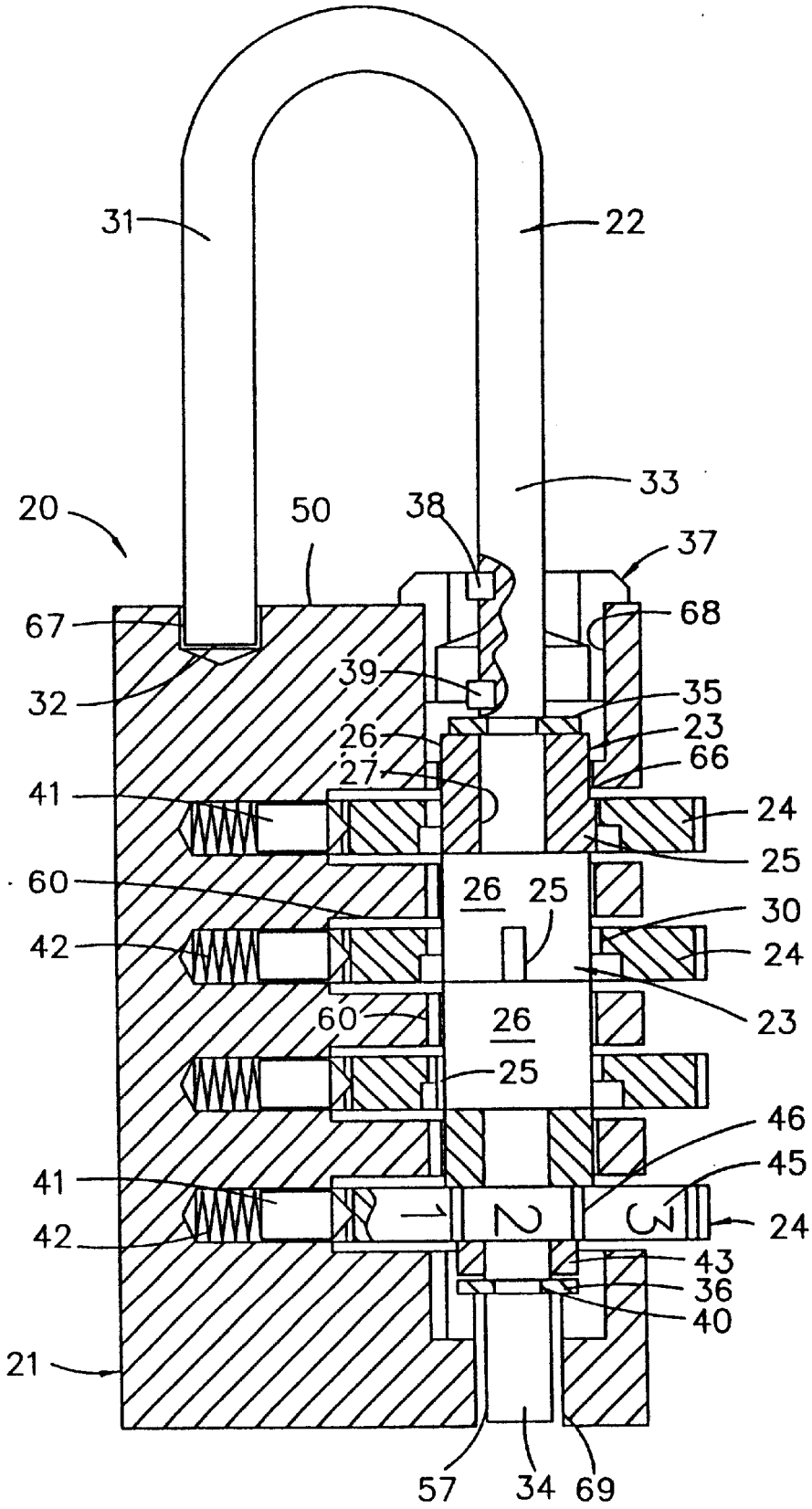
FIG. 2 is a front elevational view, partially in cross section, depicting the fully assembled combination lock of the present invention in its normal operating and locked position.
Figure 5:
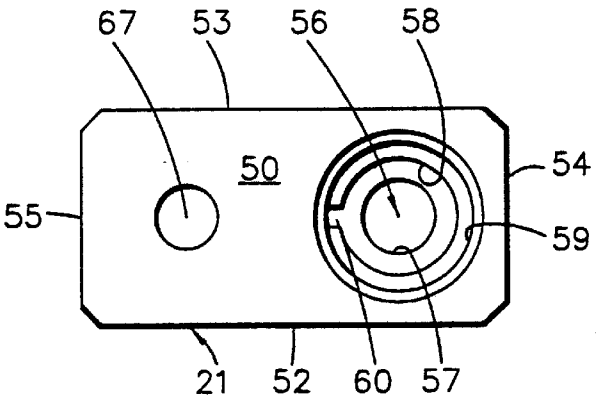
FIG. 5 is a plan view of the housing of FIG. 4.
Figure 6:
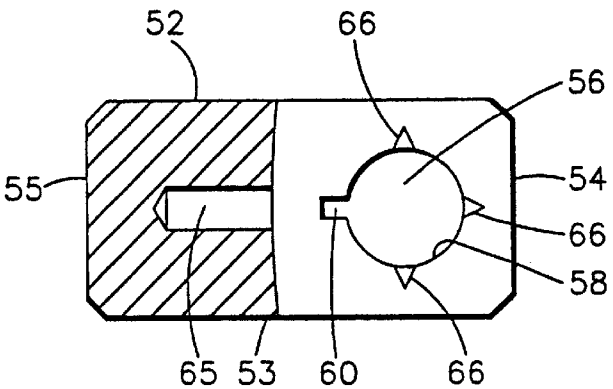
FIG. 6 is a cross-sectional plan view depicting a typical upper surface of each dial receiving zone of the housing of FIG. 4.
Figure 4:
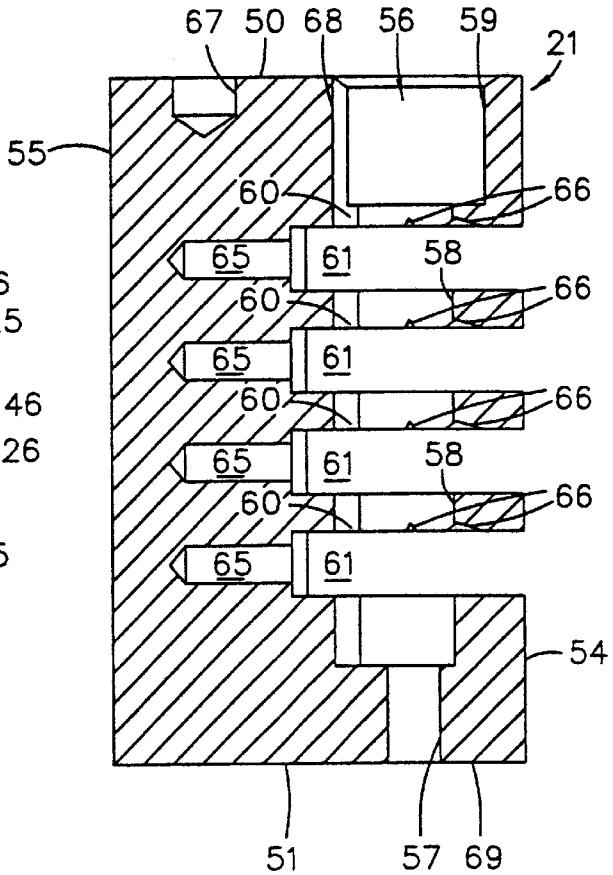
FIG. 4 is a cross-sectional front elevation view of the housing of the present invention.
Figure 3:
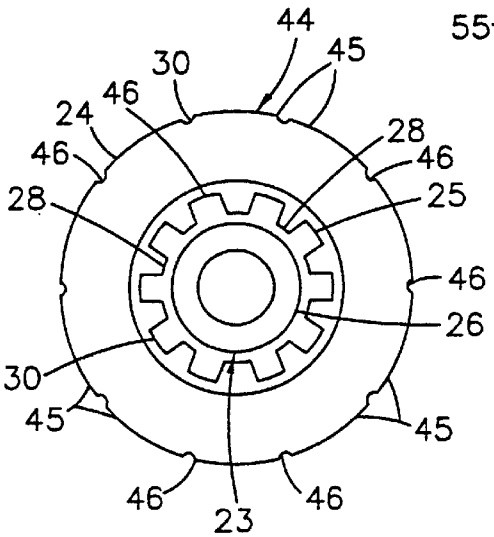
FIG. 3 is a bottom plan view of one rotating dial with one rotatable tumbler sleeve interengaged therewith.
Figure 7:
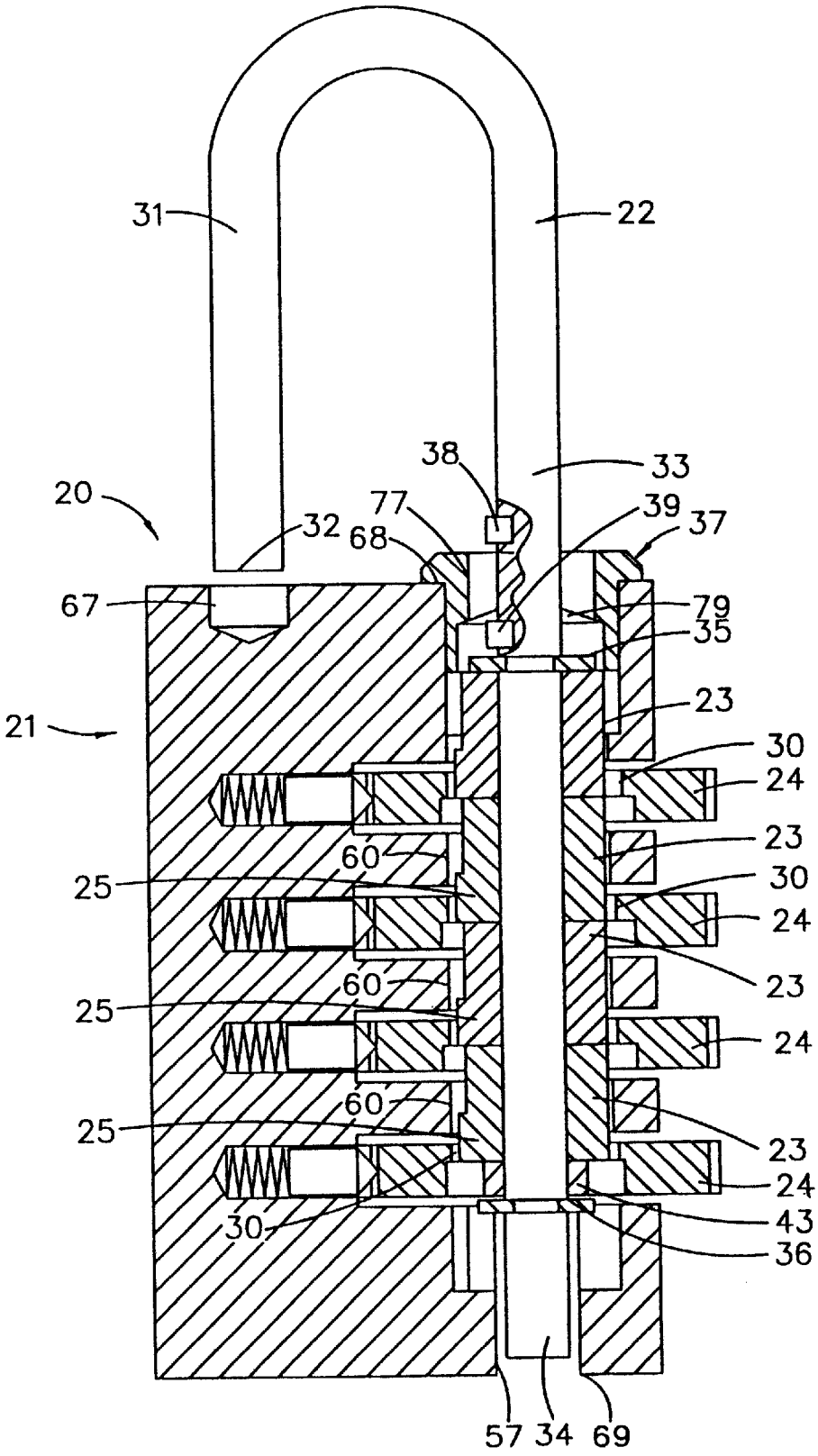
FIG. 7 is a front elevation view, mostly in cross-section, depicting the combination lock of the present invention in its unlocked configuration.
Figure 8:
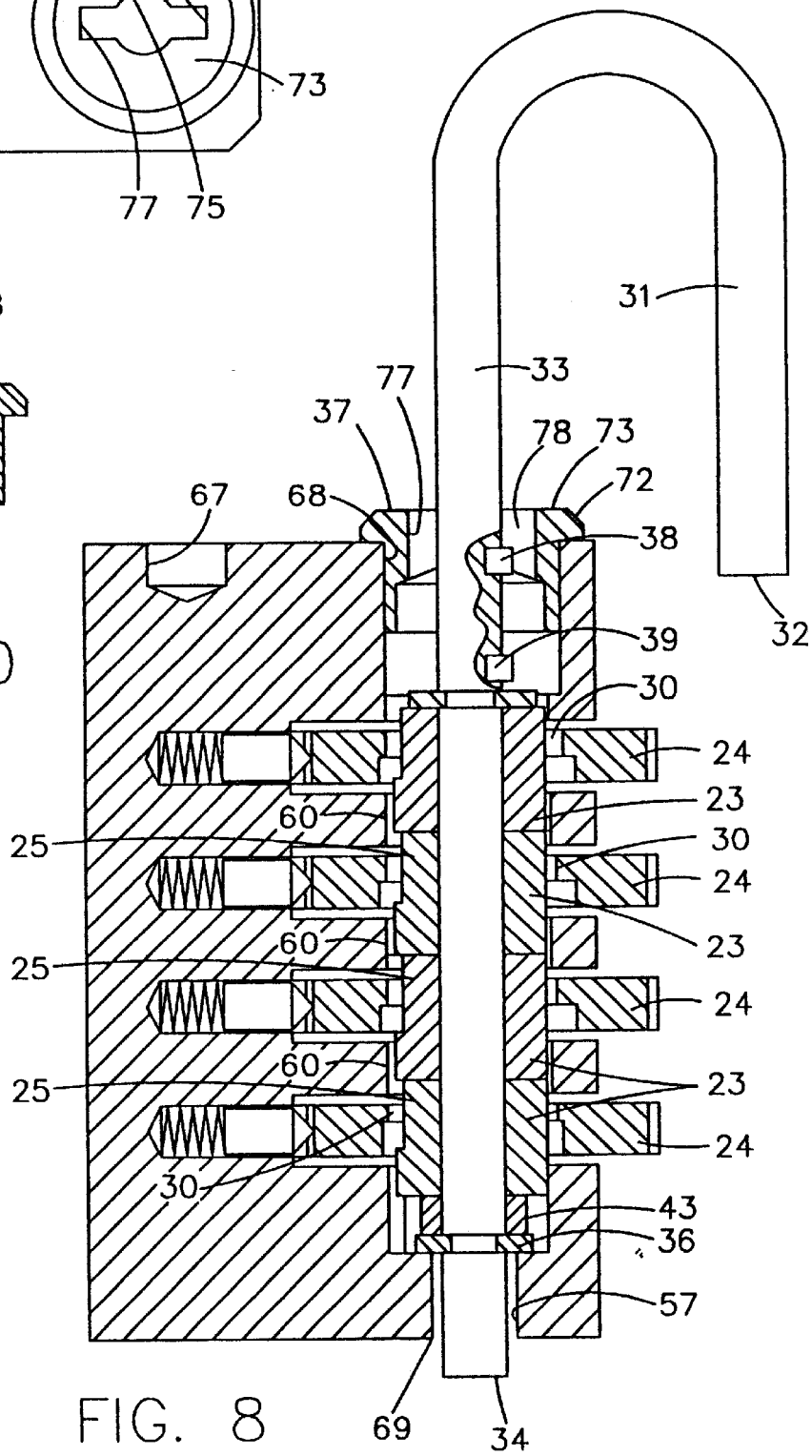
FIG. 8 is a cross-sectional front elevational view of the combination lock of the present invention, mostly in cross-section, depicting the combination lock of the present invention in its combination changing configuration.

As clearly depicted in FIGS. 2, 7 and 8, the axial distance between rib 39 and slot 40 is constructed for being substantially equivalent to the axial length required for enabling locking ring 36, when mounted in slot 40, to retain the four tumbler sleeves 23 and spacer 43 on leg 33 of shackle 22, with each tumbler sleeve 23 being capable of independent rotational movement, while substantially eliminating any axial movement thereof. In this way, tumbler sleeves 23 are able to provide the desired locking and unlocking function, while achieving this result in an easily manufactured and easily assembled construction.

As shown in FIG. 1, a visual indicator of the proper orientation for each numeral of each panel 45 of each dial 24 is also provided by incorporating on housing 21 a position orientating line 47. Line 47 enables the user to visually position each numeral in the proper location for a pre-set combination.

Another principal component of combination lock 20 of the present invention comprises housing 21. As shown in the drawings, housing 21 comprises a single piece construction, within which various cavities, bores, and receiving zones are formed. In general, housing 21 comprises a top surface 50, a bottom surface 51, a front panel 52, a rear panel 53, and two side panels 54 and 55.

In addition, housing 21 also incorporates a central, elongated bore 56 which extends through housing 21 from top surface 50 to bottom surface 51. In this regard, bore 56 comprises a first portal 68, formed with top surface 50 of housing 21 and a second portal 69 formed with bottom surface 51 of housing 21. In addition, bore 56 comprises three separate diameters, forming three separate and independent coaxial zones 57, 58, and 59. Zone 57 comprises the lowermost zone of bore 56, incorporating second portal 69 and comprises a diameter slightly greater than the diameter of shackle 22. In this way, terminating end section 34 of leg 33 of shackle 22 is capable of axial movement in zone 57 in cooperating relationship with second portal 69, while also preventing any other components mounted to leg 33 of shackle 22 from entering zone 57.

Zone 58 comprises the intermediate zone of bore 56 and has a diameter slightly greater than the outside diameter of tumbler sleeves 23. In this way, tumbler sleeves 23 are capable of axial movement through zone 58 of central bore 56. In addition, zone 58 also comprises an elongated slot or channel 60 formed along one wall of zone 58, providing the release position for each radially extending fin 25 of each tumbler sleeve 23. As is more fully detailed below, when each locking fin of each tumbler sleeve 23 is aligned with release channel 60, shackle 22 is capable of axial movement, thereby enabling shackle 22 to be removed from its locked position or, if desired, inserted into its locked position, or axially advanced through second portal 69 of zone 57 of bore 56 of housing 21, to enable the combination to be changed, set or re-set.

The final zone of bore 56 is upper zone 59 which comprises the largest diameter of bore 56. Generally, the diameter of zone 59 is constructed to enable each tumbler sleeve 23 with its radially extending fin 25 to be easily advanced through first portal 68 of zone 59. In this way, assembly of combination lock 20 is easily attained.

In addition, upper zone 59 and its associated first portal zone 68 are constructed for receiving and securely retaining sealing cap 37. In its preferred construction, sealing cap 37 comprises a cylindrical shape formed by outer surface 70 and upper flange 71. Preferably, the diameter of zone 59 is substantially equivalent to the diameter of outer surface 70 of cap 37 in order to require cap 37 to be forced into first portal 68 and zone 59 and, once inserted therein, securely affixed thereto.

In the preferred construction, washer 35, tumbler sleeves 24, spacer 43, and locking ring 36 are mounted to leg 33 of shackle 22. Then, when dials 24 are mounted in place, the fully assembled leg 33 of shackle 22 is inserted into first portal 68 of bore 56 of housing 21. The assembly is then completed by forcing sealing cap 37 into first portal 68 of zone 59 of bore 56 until the entire outer surface 70 of cap 37 is fully engaged in zone 59 and peripheral flange 71 contacts top surface 50 of housing 21.

With sealing cap 37 securely, integrally fastened to housing 21, tumbler sleeves 24 are protected from interference from environmental debris. Since bore 56 is effectively sealed from the ambient surroundings, the entry of unwanted dirt and/or debris into bore 56 is effectively prevented. As a result, longterm, trouble-free operation of combination lock 20 is provided.

In order to assure that each dial 24 is cooperatively associated with a tumbler sleeve 23 and is rotatable about leg 33 of shackle 22 along with its associated tumbler sleeve, housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. Furthermore, each dial receiving zone 61 may be cooperatively associated with a cavity 65, within which spring 42 and pin 41 are positioned for interengagement with dial 24, if employed, as detailed below.

The final aperture formed in housing 21 is shackle receiving hole 67 formed in top surface 50 of housing 21 in juxtaposed, spaced, parallel aligned relationship with central bore 56. Hole 67 is constructed for receiving terminating end 32 of leg 31 of shackle 22, providing the desired receiving holding zone for terminating end 32 whenever combination lock 22 is in its secured and locked position. As with conventional constructions, hole 67 is constructed with a diameter slightly greater than the diameter of leg 31 of shackle 22 in order to assure ease of insertion and withdrawal of leg 31 with hole 67.

By referring to FIGS. 7–10, along with the following detailed disclosure, the unlocking and combination resetting functions of combination lock 20 of the present invention can best be understood, along with the appearance of terminal end section 34 as the positive visual indicator. In FIG. 7, combination lock 20 is depicted in its unlocked position. In order to attain the unlocked position, each dial 24 must be rotated to the precise location wherein radially extending fin 25 of each tumbler sleeve 23 is aligned with release channel 60. Once each radially extending fin 25 is positioned within release channel 60, leg 33 of shackle 22 is capable of being axially raised upwardly, removing terminating end 32 of leg 31 from the secure locked interengagement within hole 67.

As shown in FIG. 7, when leg 33 of shackle 22 has been axially raised upwardly, removing leg 31 from retained interengagement with hole 67 of housing 21, each radially extending fin 25 of each tumbler sleeve 23 enters a portion of release channel 60 of housing 21. Since release channel 60 is constructed with dimensions which are slightly greater than radially extending fin 25, fin 25 of each tumbler sleeve 23 is able to easily enter channel 60, but any rotational movement of tumbler sleeve 23 or dial 24 is prevented, since each tumbler sleeve 23 is effectively locked in channel 60.

Although tumblers sleeves 23 and dials 24 are incapable of rotational movement, once leg 31 of shackle 22 is removed from hole 67, shackle 22 is capable of rotational movement about the axis defined by leg 33. However, the longitudinal axial movement of leg 33 of shackle 22 is controlled by the construction of sealing cap 37.

Figure 9:
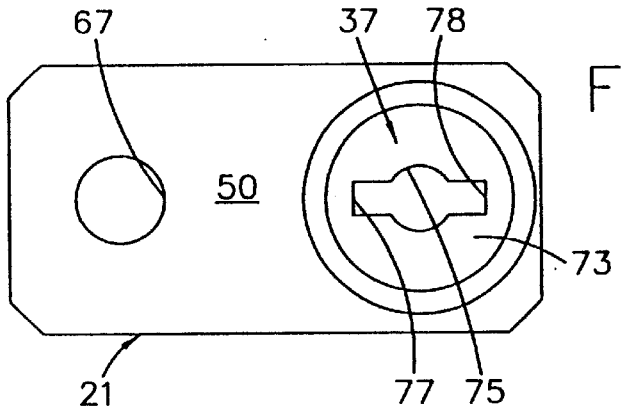
FIG. 9 is a top plan view of the fully assembled housing of FIG. 7 shown with the shackle removed.
Figure 10:
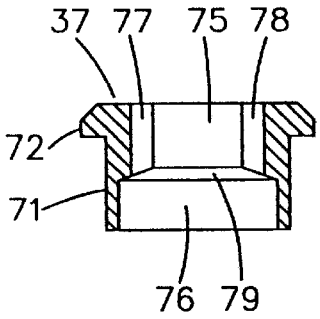
FIG. 10 is a cross-sectional elevation view of the sealing cap of the combination lock of the present invention.

As shown in FIGS. 9 and 10, sealing cap 37 is preferably constructed with a top surface 73 and 75 and 76 defining two separate and distinct substantially circular shaped inside surfaces of cap 37. Surface 75 defines a substantially circular shaped portal having a diameter slightly greater than the diameter of shackle 22. In this way, shackle 22 is freely movable in portal 75 both axially and rotationally, while also cooperating with the diameter of shackle 22 to prevent unwanted debris from entering therebetween.

In addition to portal 75, top surface 73 of sealing cap 37 also incorporates two diametrically opposed radially extending keyway slots 77 and 78 formed therein and cooperating with portal 75. Keyway slots 77 and 78 are constructed for cooperating with ribs 38 and 39 of shackle 22, in order to control the axial movement of shackle 22.

As a result of this construction, sealing cap 37 incorporates two juxtaposed, spaced, facing, inwardly extending, radial ledges 79 formed on opposed sides of aperture 75 and keyway slots 77 and 78. By employing this construction, top surface 73 and radially extending ledges 79 cooperate with ribs 38 and 39 of shackle 22 to control the axial movement of shackle 22 relative to housing 21.

As shown in FIG. 7, when combination lock 20 is in the open position, with leg 31 removed from hole 67, rib 38 is disengaged from keyway slot 77, thereby allowing shackle 22 to pivot about the central axis of leg 33. Furthermore, in this construction, washer 35 comprises an outer diameter which is less than the diameter of inside surface 76, thereby enabling washer 35 to enter the interior zone defined by inside surface 76. However, outside surface 26 of tumbler sleeve 23 is constructed with a diameter which is greater than the diameter of inside surface 76 of cap 37. As a result, the axial advance of shackle 22 upwardly is limited by the contact of the uppermost tumbler sleeve 23 with the base of sealing cap 37.

These dimensions are controlled in order to assure that rib 39 may contact radially extending ledge 79, but is incapable of entering keyway slots 77 or 78. As a result, the free rotational movement of shackle 22 is attained. In this way, a user is able to mount leg 31 of shackle 22 with any desired object for securely closing and effectively locking the object once leg 22 has been pivoted back to aligned relationship with hole 67 of housing 21.

When shackle 22 is released from engagement with hole 67, shackle 22 is capable of pivoting about the axis defined by leg 33, but is incapable of axially advancing into engagement with bore 56 due to the contact of rib 38 with top surface 73 of cap 37. The only positions in which shackle 22 is capable of axial movement is when rib 38 is aligned with keyway slot 77 or keyway slot 78. As is evident from the foregoing detailed disclosure, whenever rib 38 is aligned with keyway slot 77, shackle 22 is capable of being moved into its locked position. However, further axial advance of shackle 22 relative to housing 21 is prevented since the terminating end 32 of leg 31 engages receiving hole 67, preventing any further axial movement of shackle 22. However, as shown in FIG. 8, whenever shackle 22 is pivoted 180° from its locked position, bringing rib 38 into alignment with keyway slot 78, shackle 22 can be axially advanced into engagement with housing 21 until locking washer 36 contacts the base of intermediate zone 58 of bore 56.

As discussed above, zone 58 comprises a diameter greater than zone 57. In addition, the diameter of locking washer 36 is less than the diameter of zone 58 but greater than the diameter of zone 57. As a result, axial movement of leg 33 of shackle 22 into bore 56 is capable of being achieved until locking washer 36 contacts the base of zone 58.

Furthermore, by employing the construction of the present invention, terminating end section 34 of leg 33 of shackle 22 is constructed from cooperative axial movement through zone 57 and its associated second portal 69. As a result, whenever shackle 22 is placed in the position depicted in FIG. 8, a substantial portion of terminating end section 34 of leg 33 of shackle 22 automatically passes through second portal 69 becoming immediately visible to the user. In this way, terminating end section 34 of leg 33 of shackle 22 provides an automatically displayed, easily seen, positive visual indicator to the user that shackle 22 has been positioned in the combination setting or re-setting position.

By employing this construction, the user becomes immediately informed that combination lock 20 has been placed in its combination setting or re-setting position, enabling the user to immediately recognize and understand that any rotational movement of dials 24 will cause a new combination to be entered into lock 20. As a result, by providing the user with this positive, readily seen visual indication, the user is made immediately aware that the combination setting or re-setting position has been entered, and any possibility of changing the combination unintentionally or inadvertently is eliminated.

When shackle 22 is advanced into this position, with terminating end section 34 protruding through second portal 69 of zone 57, rib 38 passes through slot 78, enabling shackle 22 to arcuately pivot relative to housing 21. However, the removal of shackle 22 from any arcuate position is prevented due to the contact of rib 38 with ledge 79. The only position within which shackle 22 can be removed from this position is when rib 38 is aligned with keyway slot 78.

As clearly shown in FIG. 8 in addition to terminating end section 34 of shackle 22 protruding from second portal 69 of zone 57, while locking washer 36 is in contact with the base of zone 58, tumbler sleeves 23 are advanced into housing 21 into a position wherein each radially extending fin 25 of each tumbler sleeve 23 is securely mounted in channel 60 of housing 21. In addition, radially extending fins 25 of each tumbler sleeve 23 is lowered into a position whereby each radially extending fin 25 is disengaged from slot 30 of each dial 24. As a result, although tumbler sleeves 23 are incapable of being rotationally moved, due to the secure interengagement of fin 25 with slot 60, each dial 24 is free to rotate about the axis defined by shackle 22 since fin 25 has been completely disengaged from each dial 24. In this way, any desired numeral can be aligned with position orientation line 47, thereby enabling the user to select any desired combination of numbers to represent the particular combination for opening lock 20.

Once dials 24 have been arranged into the numeral sequence desired by the user to form the opening combination for lock 20, shackle 22 is pivoted to the position wherein rib 38 is aligned with keyway slot 78 and shackle 22 is axially raised upwardly until rib 38 exits slot 78 and terminating end section 34 is drawn back into zone 57. Once in this raised position, shackle 22 is capable of being freely pivoted about its central axis with leg 31 being engaged with the desired item to be locked and then pivoted into aligned relationship with hole 67 for securing combination lock 20 in the precisely desired location.

Another feature provided by the preferred embodiment of the present invention is the continued visibility of terminating end section 34 until each of the combination designating indicia of dial 24 has been properly entered into combination lock 20. In this regard, if dial 24 has been placed in a position wherein one of the designating indicia is not properly aligned with the combination designating orientation line, fin 25 of the tumbler sleeve 23 associated with this misaligned dial remains engaged with a portion of dial 24, preventing the axial movement of shackle 22. As a result, shackle 22 cannot be actually moved relative to housing 21.

As a result, terminating end section 34 remains in its exposed, visually indicating position, informing the user that the desired combination has not been properly entered on dials 24. However, once this error is corrected, shackle 22 can be axially returned to its original position. As a result, by employing this construction, an additional advantage and further ease of operation is provided, with the user being immediately notified of entry into the combination setting or re-setting position, as well as when combinations have been erroneously or improperly entered.

By referring to FIGS. 11–21 along with the following detailed disclosure, further alternate embodiments and constructions of the combination lock 20 of the present invention can best be understood. As fully detailed below, these embodiments describe and define the construction and operation of combination lock 20 wherein two separate and independent locking members or locking elements are employed.

In the following detailed disclosure, four alternate constructions for this embodiment of the present invention are detailed. In addition, each of these alternate embodiments may be employed separately or in combination with the various constructions detailed above. Consequently, a wide variety of configurations can be attained by employing the present invention without departing from the scope of this invention. Furthermore, although four separate and independent alternate constructions are depicted in FIGS. 11–21, further alternate constructions may also be achieved using the present invention. Consequently, it is intended that all such variations are encompassed by the present invention and included within the scope thereof.

In each of the embodiments detailed below, combination lock 20 incorporates shackle 22 as one of the locking elements for securely closing and locking any desired product, when desired by the user. In addition to the incorporation of shackle 22, combination lock 20 also incorporates a second locking zone or locking element for enabling a wide variety of alternate products to be securely locked, which otherwise may not be capable of being locked using the configuration of shackle 22. In FIGS. 11–21, this alternate locking member is depicted as elongated flexible cable or wire member 85.

In addition, in each of these embodiments, elongated flexible cable or wire member 85 comprises a fixed end 86 and a lockable end 87, which is constructed for mating locked engagement with housing 21, as well as disengagement therefrom when desired. In addition, cable member 85 is preferably constructed from flexible, woven wire which is integrally engaged with and extends between fixed end 86 and lockable end 87. In this way, cable member 85 is capable of being flexibly extended and lockingly engaged with a plurality of alternate products, constructions, and configurations, which shackle 22 would be incapable of lockingly engaging.

Figure 11:
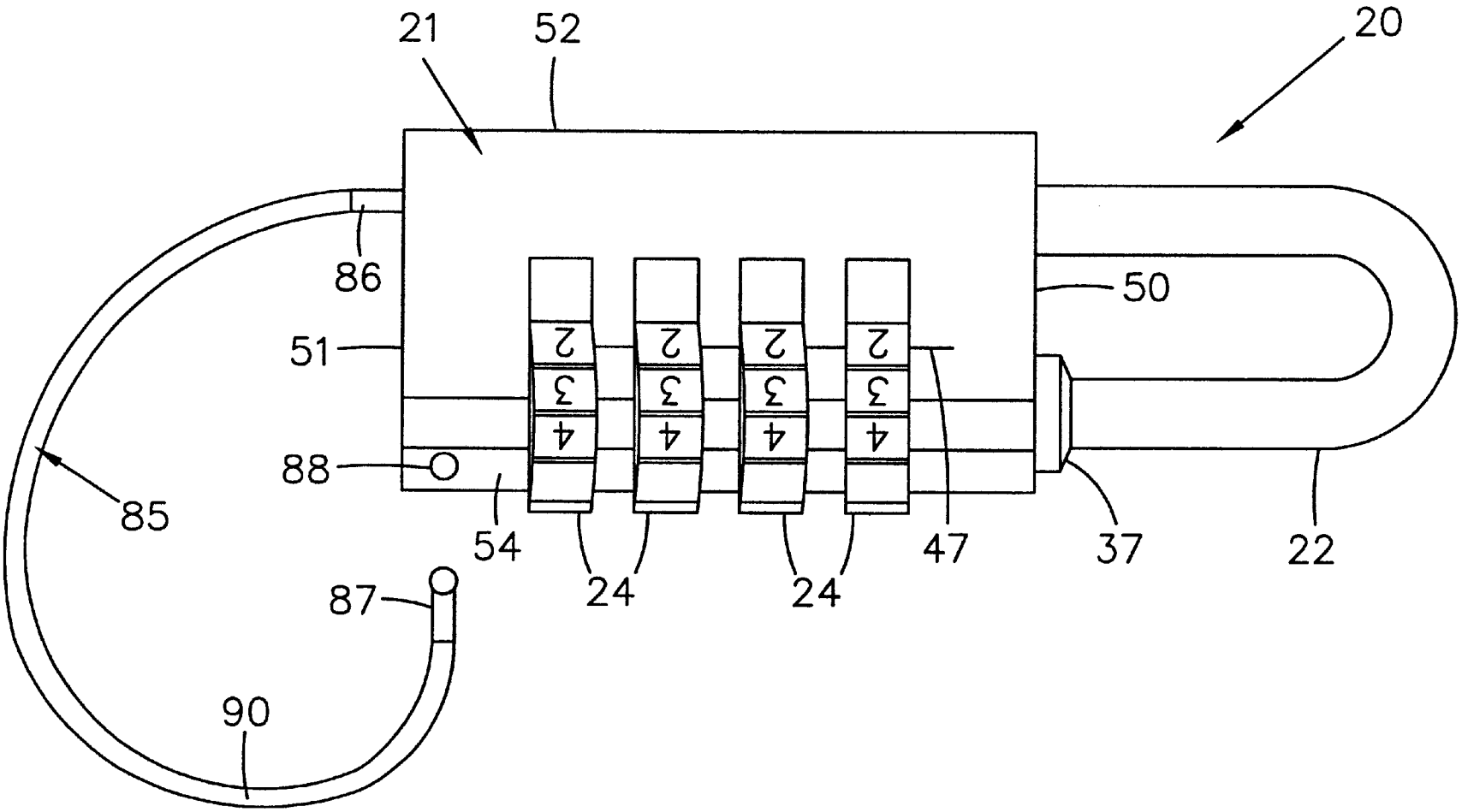
FIG. 11 is a perspective view of an alternate embodiment of the combination lock of the present invention which incorporates two separate and independent locking means formed on a single housing as is shown fully assembled and in its locked position.
Figure 12:
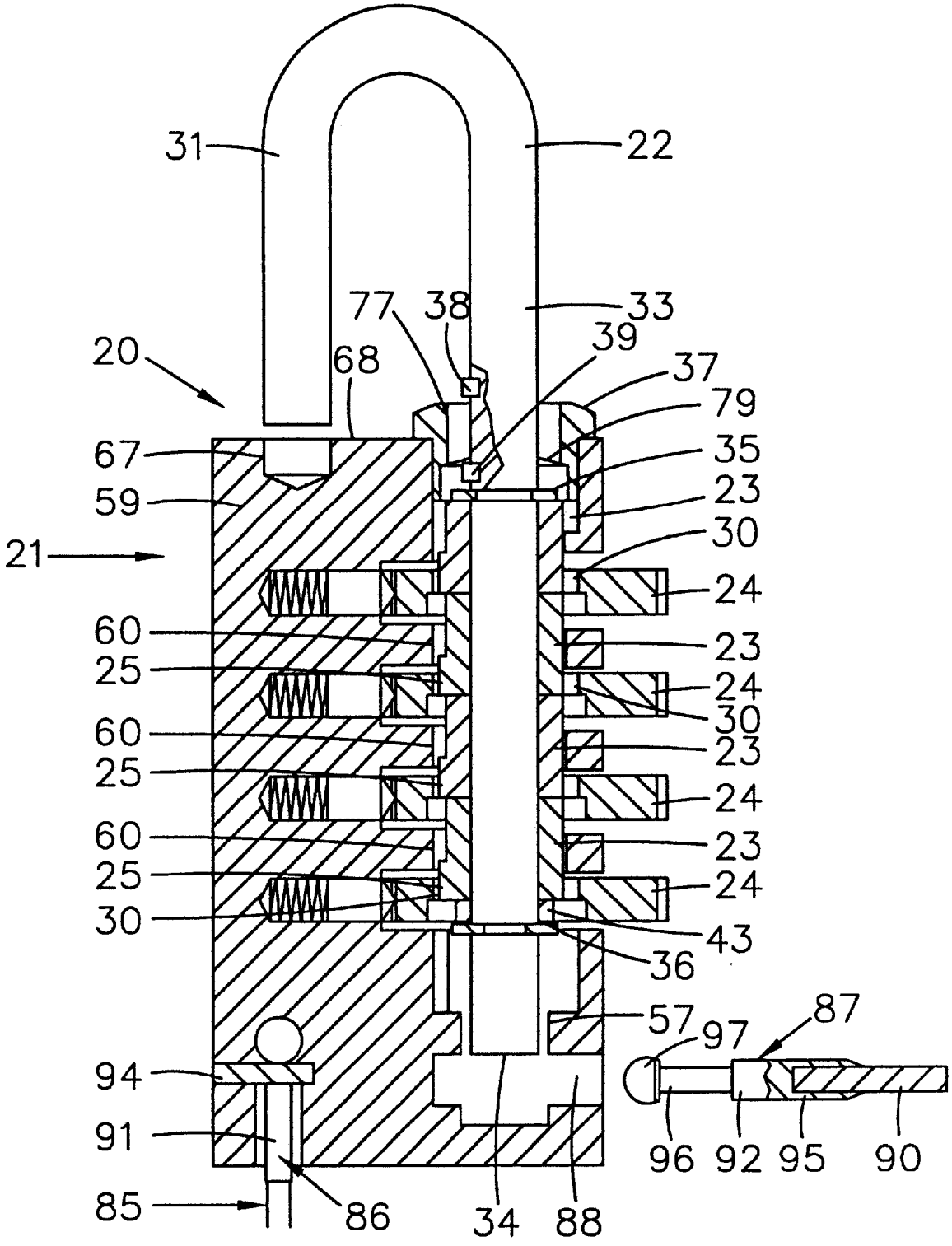
FIG. 12 is a front elevational view, mostly in cross-section, depicting the combination lock of FIG. 11 with both separate and independent locking means shown in their unlocked configuration.
Figure 13:
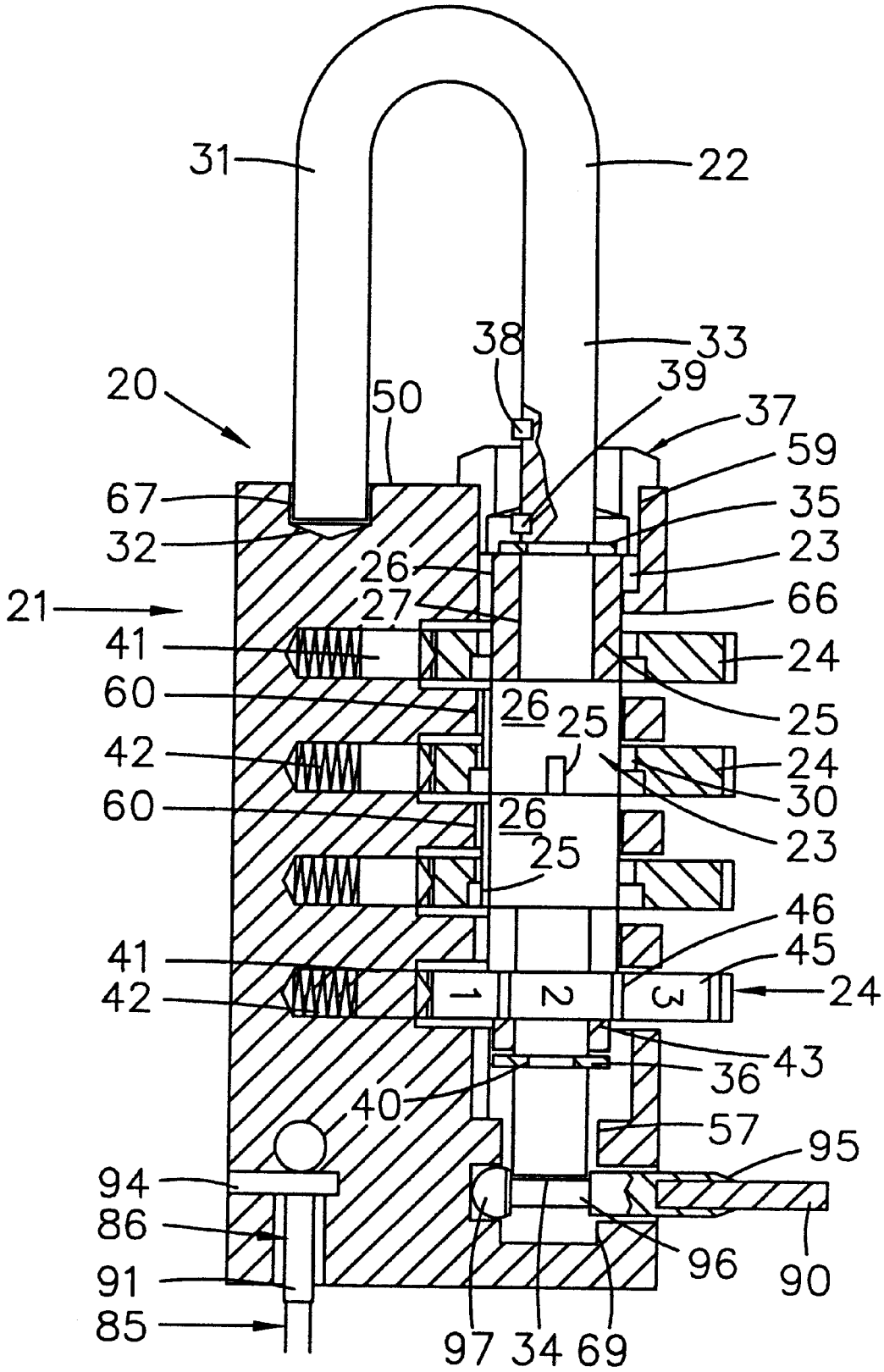
FIG. 13 is a front elevational view, mostly in cross-section, depicting the combination lock up of FIG. 11, with both separate and independent locking means shown in their fully locked positions.

In FIGS. 11–13, one construction of this alternate embodiment of combination lock 20 of the present invention is fully detailed. As depicted, in this embodiment, combination lock 20 comprises housing 21, shackle 22, and a plurality of tumbler sleeves 23 in combination with rotatable dials 24, all of which are constructed and arranged in a manner substantially identical to the constructions detailed above. In this regard, each tumbler sleeve 23 comprises a generally cylindrical shape incorporating a single locking fin 25 radially extending from outer, circular shaped surface 26. In addition, each tumbler sleeve 23 also comprises an inside, circular shaped surface 27 which is coaxially aligned with outside surface 26. The diameter of inside surface 27 of tumbler sleeve 23 is constructed to enable each tumbler sleeve 23 to freely pivot about the outer surface of shackle 22.

Each dial 24 is constructed for peripherally surrounding and cooperating with tumbler sleeve 23. In this regard, each dial 24 comprises two separate and distinct circular shaped inside surfaces 28 and 29. Inside surface 28 comprises a diameter slightly greater than the diameter of outside surface 26 of tumbler sleeve 23, in order to enable tumbler sleeve 23 and dial 24 to cooperate with each other while being independently rotationally movable about shackle 22.

In addition, each dial 24 comprises a plurality of slots 30 formed in inside surface 28, with each slot being constructed for receiving and retaining radially extending fin 25 of tumbler sleeve 23. In this way, whenever radially extending fin 25 is mounted in a slot 30 of dial 24, tumbler sleeve 23 and dial 24 are in interlocked engagement, causing both members to rotate together about shackle 22.

In this embodiment, as with the embodiments detailed above, shackle 22 comprises a conventional J-shape, incorporating a short leg 31 with terminating end 32 and a long leg 33 having terminating end 34. In addition, each tumbler sleeve 23 is rotationally mounted to leg 33 of shackle 22, with each tumbler sleeve having a dial 24 rotationally associated therewith. As fully detailed below, terminating end 34 is constructed for cooperating, locking engagement with end 87 of cable member 85 to provide the desired secure locked interengagement of end 87 of cable member 85 in housing 21, whenever desired by the user.

As discussed above, each dial 24 has a plurality of indicia formed on the outer peripheral surface thereof, each of which represents one component of the combination for positioning tumbler sleeve 23 in the requisite location for releasing shackle 22. Although any desired indicia may be employed, numerals or letters are typically employed on such combination lock constructions. In the present invention, each dial 24 comprises an outer surface 44 on which ten panels 45 are formed with slots 46 separating each panel 45. In addition, one numeral ranging from 0, 1, 2, 3, 4, 5, 6, 7, 8, and 9 is formed on each panel 45. The numeral in each panel 45 of each dial 24 is then employed to define the combination for lock 20.

As in the embodiments detailed above, the remaining components employed to formed combination lock 20 of the present invention comprise washer 35, split locking ring 36, sealing cap 37, and spacer 43. In the preferred construction, leg 33 of shackle 22 incorporates ribs 38 and 39 formed on the outer surface thereof and a locking ring receiving slot 40 formed directly adjacent terminating end 34 of leg 33 of shackle 22.

As detailed above, this construction enables locking ring 36, when mounted in slot 40, to retain the four tumbler sleeves 23 and spacer 43 on leg 33 of shackle 22, with each tumbler sleeve 23 being capable of independent rotational movement, while substantially eliminating any axial movement thereof. In this way, tumbler sleeves 23 are able to provide the desired locking and unlocking function, while achieving this result in an easily manufactured and easily assembled construction.

As shown in FIG. 11, and detailed above in regard to the alternate embodiments, a visual indicator of the proper orientation for each numeral of each panel 45 of each dial 24 is provided by incorporating position orienting line 47 on housing 21. Line 47 enables the user to visually position each numeral in the proper location for displaying the precisely desired preset combination.

In addition, as previously detailed, housing 21 comprises a single piece construction within which the various cavities, bores and receiving zones are formed. In general, housing 21 comprises a top surface 50, a bottom surface 51, a front panel 52, a rear panel 53, and two side panels 54 and 55.

As shown in FIGS. 11–13, housing 21 also incorporates a central, elongated bore 56 which extends a substantial distance through housing 21, starting from top surface 50 and terminating at adjacent bottom surface 51. In addition, in this embodiment, housing 21 also incorporates cable end receiving bore 88 formed in side panel 54 directly adjacent bottom surface 51. In the preferred construction, bore 88 extends from side panel 54 into interconnected, intersecting engagement with bore 56, preferably formed substantially perpendicularly to bore 56.

In addition, central, elongated bore 56 comprises a first portal 68, formed with top surface 50 of housing 21 and three separate diameters, forming three separate and independent coaxial zones 57, 58, and 59. Zone 57 comprises the lowermost zone of bore 56 and intersects with bore 88. In addition, zone 57 comprises a diameter slightly greater than the diameter of shackle 22. In this way, terminating end 34 of leg 33 of shackle 22 is capable of axial movement in zone 57 in cooperating relationship with bore 88 and lockable end 87 of cable member 85.

Zone 58 comprises the intermediate zone of bore 56 and has a diameter slightly greater than the outside diameter of tumbler sleeves 23. In this way, tumbler sleeves 23 are capable of axial movement through zone 58 of central bore 56. In addition, zone 58 also comprises an elongated slot or channel 60 formed along one wall of zone 58, providing the release position for each radially extending fin 25 of each tumbler sleeve 23. As fully detailed above, when each locking fin of each tumbler sleeve 23 is aligned with release channel 60, shackle 22 is capable of axial movement. This axial movement enables shackle 22 to be removed from its locked position or, if desired, inserted into its locked position, or axially advanced through bore 88 and zone 57 of bore 56 of housing 21, to enable the combination to be changed, set or re-set. In addition, as detailed below, the axial movement also enables lockable end 87 of cable member 85 to be lockingly engaged or disengaged with housing 21.

The final zone of bore 56 is upper zone 59 which typically comprises the largest diameter of bore 56. Generally, the diameter of zone 59 is constructed to enable each tumbler sleeve 23 with its radially extending fin 25 to be easily advanced through first portal 68 of zone 59. In this way, assembly of combination lock 20 is easily attained.

In addition, upper zone 59 and its associated first portal 68 are constructed for receiving and securely retaining sealing cap 37. In its preferred construction, sealing cap 37 comprises a cylindrical shape formed by outer surface 70 and upper flange 71. Preferably, the diameter of zone 59 is substantially equivalent to the diameter of outer surface 70 of cap 37 in order to require cap 37 to be forced into first portal 68 and zone 59 and, once inserted therein, securely affixed thereto.

In the preferred construction, washer 35, tumbler sleeves 24, spacer 43, and locking ring 36 are mounted to leg 33 of shackle 22. Then, when dials 24 are mounted in place, the fully assembled leg 33 of shackle 22 is inserted into first portal 68 of bore 56 of housing 21. The assembly is then completed by forcing sealing cap 37 into first portal 68 of zone 59 of bore 56 until the entire outer surface 70 of cap 37 is fully engaged in zone 59 and peripheral flange 71 contacts top surface 50 of housing 21.

With sealing cap 37 securely, integrally fastened to housing 21, tumbler sleeves 24 are protected from interference from environmental debris. Since bore 56 is effectively sealed from the ambient surroundings, the entry of unwanted dirt and/or debris into bore 56 is effectively prevented. As a result, longterm, trouble-free operation of combination lock 20 is provided.

In order to assure that each dial 24 is cooperatively associated with a tumbler sleeve 23 and is rotatable about leg 33 of shackle 22 along with its associated tumbler sleeve, housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. Furthermore, each dial receiving zone 61 may be cooperatively associated with a cavity 65, within which spring 42 and pin 41 are positioned for interengagement with dial 24, if employed, as detailed below.

The final aperture formed in housing 21 is shackle receiving hole 67 formed in top surface 50 of housing 21 in juxtaposed, spaced, parallel aligned relationship with central bore 56. Hole 67 is constructed for receiving terminating end 32 of leg 31 of shackle 22, providing the desired receiving holding zone for terminating end 32 whenever combination lock 22 is in its secured and locked position. As with conventional constructions, hole 67 is constructed with a diameter slightly greater than the diameter of leg 31 of shackle 22 in order to assure ease of insertion and withdrawal of leg 31 with hole 67.

In the preferred construction of this embodiment of the present invention, flexible cable assembly 85 is constructed with end 86 fixedly secured to housing 21 of combination lock 20. Although the secure affixation of end 86 to housing 21 may be achieved in a wide variety of alternate constructions, FIGS. 11–18 detail one embodiment, for exemplary purposes only, while FIGS. 19–22 depict an alternate embodiment.

As previously discussed, cable member 85 comprises an elongated, continuous length of a cable or cord member 90 which is formed from any desired non-breakable or tamper resistant material. Preferably, woven or braided wire fibers or filaments are employed for forming cable member 90. However, any desired alternate material or construction can be employed which provides a continuous length of material which is resistant to being cut or broken.

In addition, ends 86 and 87 are each formed from caps or covers 91 and 92, each of which are securely fixedly mounted to one terminating end of cable member 90. As depicted, cap/cover 91 forms fixedly mounted end 86 and comprises a construction which is fixedly mounted in cap receiving hole 93 formed in bottom 51 of housing 21.

In the embodiment depicted in FIGS. 11–18, end-forming cap 91 is securely retained in hole 93 by anchor means 94, such as rivets, pins, brackets, and the like, which are secured directly to cap 91 through side panel 55 of housing 21. Alternatively, if desired, cap 91 may be press fitted into hole 93 to achieve the desired securement thereof to housing 21.

In all of the embodiments of this invention, end forming cap or cover 92 is securely affixed to the opposed end of cable member 90. Both caps/covers 91 and 92 are mounted to cable member 90 in a manner which integrally attaches caps 91 and 92 to cable member 90 in order to prevent unwanted separation or removal. In this regard, any desired affixation method may be employed, such as swaging, adhesive bonding, sonic welding, and the like. Regardless of which method is employed, caps/covers 91 and 92 are independently secured to cable member 90 in a manner which prevents their removal or separation from cable member 90.

In order to enable lockable end 87 of flexible cable assembly 85 to be easily lockingly engaged or disengaged from housing 21, cap/cover 92 is preferably constructed on each embodiment of this invention with a substantially cylindrical body portion 95 which is fixedly mounted to one end of cable member 90. In addition, rod or finger portion 96 co-axially extends from body portion 95 with a diameter less than the diameter of body portion 95. Finally, enlarged terminating end portion 97 is formed at the distal end of rod portion 96, comprising a generally rounded configuration and a diameter substantially equal to the diameter of body portion 95.

By constructing end-forming cap 92 of lockable end 87 in the manner detailed above, the cooperative locking engagement and unlocking disengagement of flexible cable assembly 85 with housing 21 is achieved. In this regard, the diameter employed for forming terminating end portion 97 and body portion 95 is selected for cooperating sliding engagement with receiving bore 88. As a result, a diameter slightly less than the diameter of bore 88 is preferred in order to assure ease of axial sliding engagement and disengagement of cap/cover 92 in bore 88.

As shown in FIG. 12, when all of the numerals of dials 24 are arranged in a manner which forms the pre-selected combination, shackle 22 is capable of being axially raised relative to housing 21. This axial movement allows leg 33 of shackle 22 to be moved upwardly, within bore 56 of housing 21, causing terminating end 34 of leg 33 to be moved away from bore 88, to a position wherein end 34 does not block bore 88 in any manner.

When shackle 22 is in this raised, unlocked position, cap 92 of lockable end 87 is able to be freely, telescopically inserted into bore 88 until fully engaged therewith, with terminating end portion 97 abutting the base of bore 88. When in this position, as shown in FIG. 13, rod portion 96 of cap 92 is aligned with the intersecting juncture between bore 88 and zone 57 of bore 56.

When cap 92 is fully inserted into bore 88, as detailed above, combination lock 20 may be moved from its unlocked position to its fully locked position, with both shackle 22 and flexible cable assembly 85 securely locked as desired. In order to attain this result, shackle 22 is axially moved downwardly in housing 21, causing leg 33 to advance further into bore 56. In addition, shorter leg 31 of shackle 22 is aligned with hole 67 of housing 21 and terminating end 32 is advanced into hole 67, securely locking shackle 22 to housing 21. In order to maintain this locked position, dials 24 are rotated, thereby preventing any further axial movement of shackle 22 until the pre-set combination is displayed again by dials 24.

As shown in FIG. 13, as shackle 22 is moved into its locked position, terminating end 34 of leg 33 of shackle 22 is advanced into engagement with rod portion 96 of cap 92 of lockable end 87. In this regard, the overall length of leg 33 is constructed to assure engagement of end 34 with rod portion 96 in bore 88. Once dials 23 are rotated and axial withdrawal of shackle 22 is prevented, lockable end 87 is securely, lockingly engaged with housing 21 since the engagement of end 34 of leg 33 with rod portion 96 prevents cap 92 of lockable end 87 to be axially moved or withdrawn from bore 88. As a result, cap 92 is securely locked to housing 21.

As clearly shown in FIG. 13, axial movement of cap 92 is prevented due to the abutting contact of larger diameter terminating end portion 97 with leg 33. As a result of this engagement, removal of cap 92 of lockable end 87 is prevented and securement to housing 21 is realized.

Prior to securely lockingly engaging lockable end 87 to housing 21, flexible cable assembly 85 is inserted through the product desired to be locked. As a result, when end 87 is secured to housing 21, as detailed above, the product is securely locked therewith.

Whenever the product secured by flexible cable assembly 85 is to be released or open, the process detailed above is reversed to release lockable end 87 from engagement with housing 21. In order to achieve this result, the desired, pre-set combination is displayed on dials 24, thereby enabling shackle 22 to be axially moved.

Once leg 33 of shackle 22 is moved upwardly terminating end 34 of leg 33 is removed from engagement with rod portion 96, thereby allowing termination end 97 to move axially out of bore 88. In this way, the desired release of lockable end 87 is attained, allowing terminating end 97 to move axially out of bore 88. In this way, the desired release of lockable end 87 is attained and any product secured thereby is able to be released.

In FIGS. 14–22, three further alternate constructions are depicted for attaining a combination lock 20 with two separate and independent locking means. In each of these embodiments, as with the embodiment detailed above and shown in FIGS. 11–13, lock 20 comprises shackle 22 as one locking member and flexible cable assembly 85 as the second locking means.

In addition, in each of these embodiments, flexible cable assembly 85 comprises an elongated cable or cord member 90, a fixed end 86 secured to one end of cable member 90 and a lockable end 87 secured to the opposed end of cable member 90. Furthermore, fixed end 86 comprises a cap or cover 91 which is secured to housing 21 in a manner substantially identical to the securement means shown and detailed above in FIGS. 11–13.

Finally, lockable end 87 of each embodiment comprises a cap or cover 92 which is constructed in a manner substantially identical to the construction detailed above and shown in FIGS. 11–13, with cap 92 comprising cylindrical body portion 95, affixed to cable member 90, smaller diameter rod or finger portion 96 coaxially extending from body portion 96, and terminating end portion 97 affixed to rod portion 96 and having a diameter greater than rod portion 96.

Figure 15:
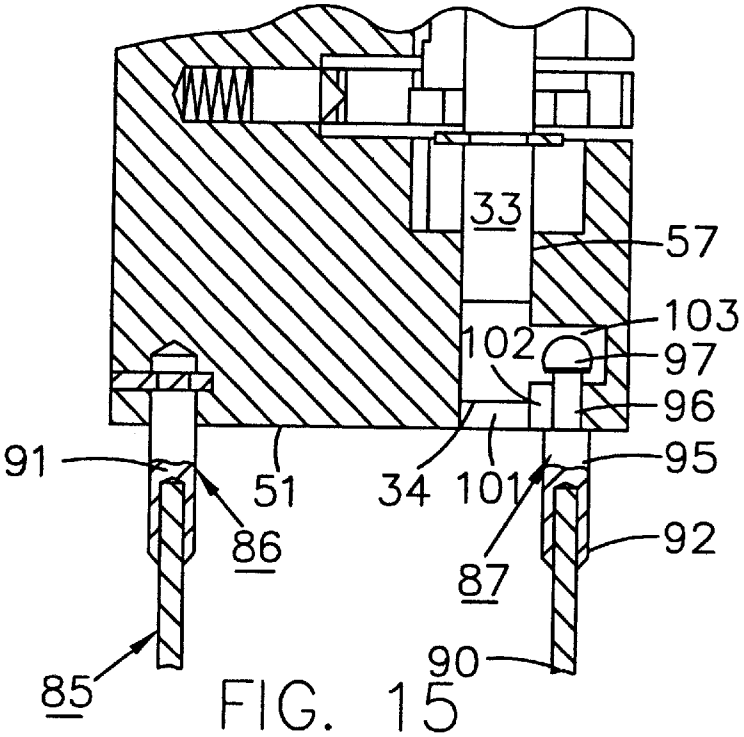
FIG. 15 is a front elevational view, mostly in cross-section and partially broken away, depicting the embodiment of the combination lock of FIG. 14 with the two separate and independent locking means shown in their fully locked positions.
Figure 16:
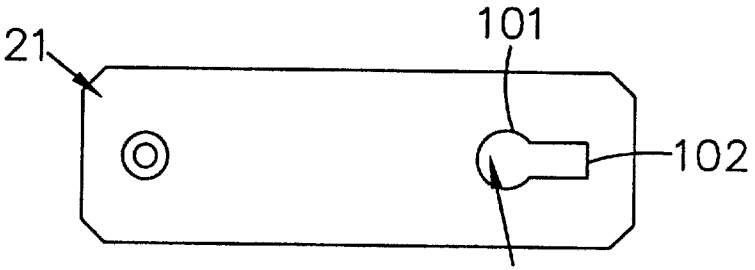
FIG. 16 is a bottom plan view of the embodiment of the combination lock of FIG. 14.
Figure 14:
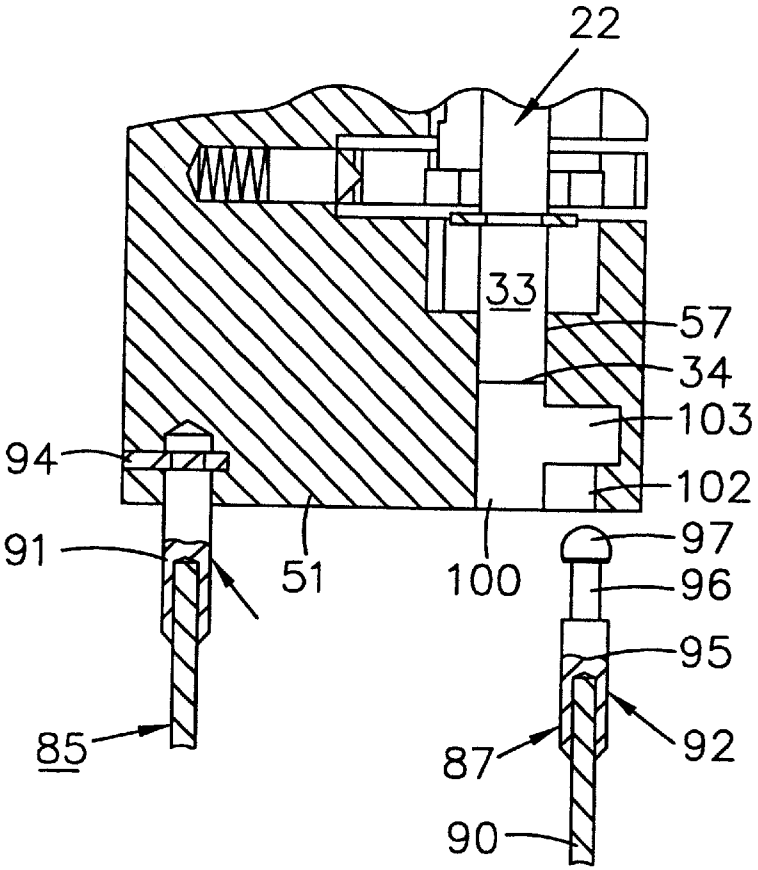
FIG. 14 is a front elevational view, mostly in cross-section and partially broken away, depicting an alternate embodiment of the combination lock of the present invention having two separate and independent locking means with both locking means shown in their unlocked position.

Although each of the embodiments shown in FIGS. 11–22 comprises a flexible cable assembly 85 having substantially identical constructions, each embodiment employs a separate and distinct locking system. One such alternate construction is shown in FIGS. 14, 15, and 16, wherein housing 21 comprises a keyhole shape aperture 100 formed in bottom surface 51 of housing 21.

As depicted, the keyhole shaped aperture 100 comprises a circular hole portion 101 having a diameter substantially equal to and coaxially aligned with zone 57 of bore 56. In view of this construction, leg 33 of shackle 22 is free to axially move through both zone 57 of bore 56 and circular hole portion 101.

In addition to circular hole portion 101, keyhole shaped aperture 100 comprises slot 102, which is diametrically aligned with hole portion 101 and comprises a width less than the diameter of hole 101. As a result, slot 102 defines a reduced width zone for aperture 100. Furthermore, slot 102 is constructed with a width greater than the diameter of rod portion 96 but less than the diameter of terminating end portion 97.

Finally, this embodiment of the present invention is completed by forming holding cavity 103 in housing 21, positioned directly above slot 102 in interconnected, communicating relationship with circular hole portion 101. In the preferred construction, holding cavity 103 is dimensioned for receiving and retaining terminating end portion 97.

By employing this construction, secure, locked interengagement of lockable end 87 of flexible cable assembly 85 with housing 21 is easily achieved, as well as rapid disengagement thereof, whenever desired. By referring to FIGS. 14, 15, and 16, along with the following detailed disclosure, the rapid, secure locked interengagement of end 87 with housing 21 will be fully understood, as well as the rapid disengagement thereof, when desired.

As depicted, when leg 33 of shackle 22 is in its unlocked, open position, as shown in its entirety in FIG. 12, leg 33 of shackle 22 is in an upwardly, raised position, with end 34 of leg 33 positioned in zone 57 of bore 56. Furthermore, when in this position, leg 33 of shackle 22 is completely removed from hole portion 101 and holding cavity 103 of housing 21.

When this open, unlocked position is attained, lockable end 87 of flexible cable assembly 85 is able to be inserted into the hole-shaped aperture 100 and holding cavity 103. In this regard, terminating end portion 97 is aligned with circular hole portion 101 and telescopically inserted therein. Once terminating end portion 97 has passed by slot 102, lockable end 87 is able to be moved laterally, causing terminating end portion 97 to enter holding cavity 103, while rod portion 96 enters slot 102. Due to the construction of holding cavity 103 and slot 102, vertical withdrawal of lockable end 97 from this position is incapable of being achieved.

To secure lockable end 87 in this position, shackle 22 is moved from its open position to its closed position, as fully depicted in FIG. 13. In its closed position, leg 33 of shackle 22 is moved downwardly into hole portion 101, completely blocking holding cavity 103. As depicted, when in this final, locked position, end 34 of leg 33 of shackle 22 is positioned below the entrance to holding cavity 103.

As a result, lockable end 87 of flexible cable assembly 85 is incapable of being withdrawn from secure engagement with cavity 103 and slot 102, thereby securely affixing and lockably maintaining end 87 in secure interengagement with housing 21. As is evident from the preceding detailed disclosure, vertical movement or withdrawal of lockable end 87 from this position is impossible, since terminating end portion 97 comprises a diameter greater than the width of slot 102, thereby preventing its removal from holding cavity 103.

Whenever the user desires to remove lockable end 87 from secure engagement with housing 21, dials 24 are rotated to display the pre-set combination, thereby enabling shackle 22 to be axially movable relative to housing 21, as previously detailed. Once the desired combination has been properly displayed, leg 33 of shackle 22 is axially moved upwardly, causing terminating end 34 of leg 33 to move from blocking engagement with holding cavity 103, as shown in FIG. 15, to the positioned depicted in FIG. 14, wherein terminating end 34 of leg 33 of shackle 22 is positioned in holding zone 57, completely opening the juncture between hole portion 101 and holding cavity 103. Once this position has been attained, lockable end 87 is easily moved laterally, placing terminating end portion 97 and rod portion 96 in hole portion 101, and then axially withdrawing terminating end portion 87 from hole portion 101 to attain the desired unlocked configuration.

Figure 18:
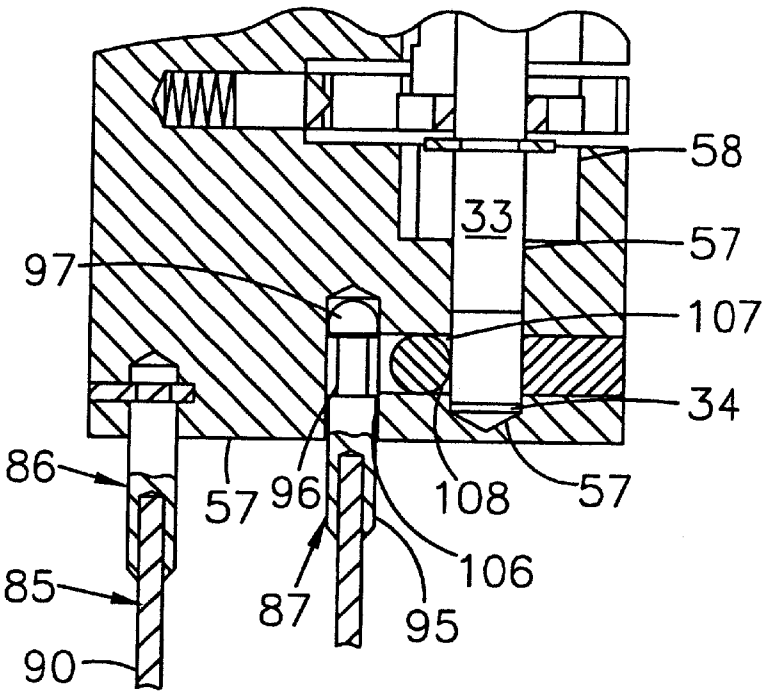
FIG. 18 is a front elevational view, mostly in cross-section and partially broken away, depicting the embodiment of the combination lock of FIG. 17 with the two separate and independent locking means shown in their fully locked positions.
Figure 17:
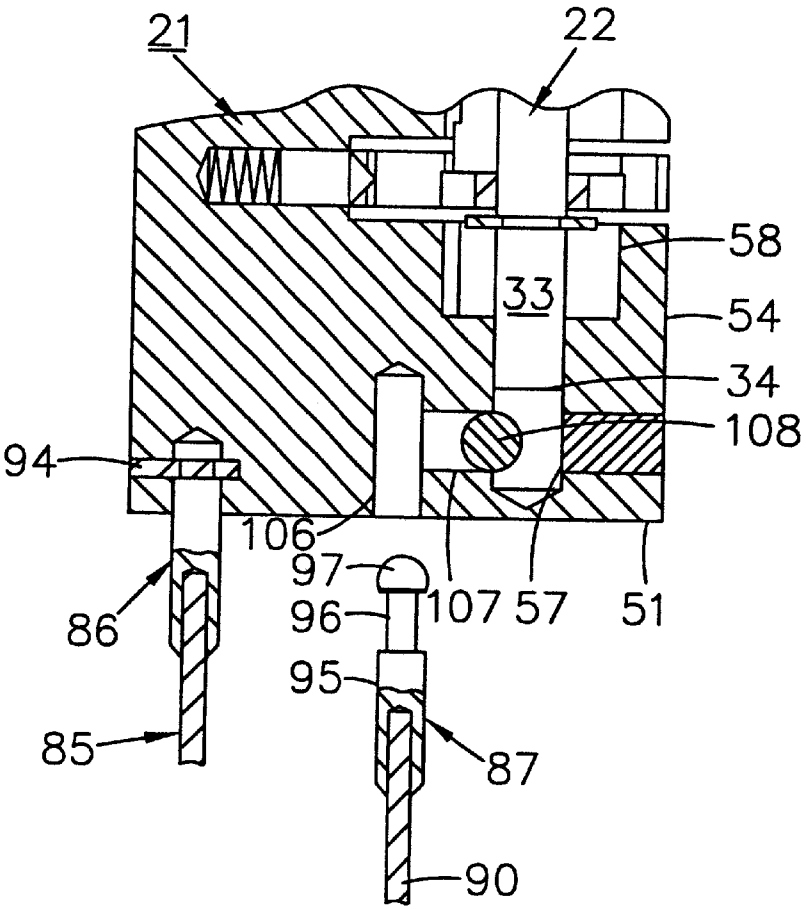
FIG. 17 is a front elevational view, mostly in cross-section and partially broken away, depicting a further alternate embodiment of the combination lock of the present invention having two separate and independent locking means with both locking means shown in their unlocked position.

By referring to FIGS. 17 and 18, along with the following detailed discussion, the construction and operation of a further alternate embodiment for a secondary locking system can best be understood. In this embodiment, housing 21 comprises an elongated receiving bore 106 formed in bottom surface 51 in juxtaposed, spaced, relationship with zone 57 of bore 56. In this regard, the central axis of bore 106 is constructed to be substantially parallel to the central axis of zone 57.

Housing 21 also incorporates an interconnecting cavity 107 extending between bore 106 and zone 108, providing interconnecting, communicating relationship therebetween. In addition, bore 106 comprises a depth which extends beyond zone 107 by a distance substantially equal to the length of terminating end. In this way, rod portion 96 is aligned with zone 107 when lockable end 87 is fully inserted into bore 106.

Finally, locking member 108, preferably in the form of a spherical ball or bearing, is positioned in interconnecting zone 107. As detailed below, this construction provides the desired rapid, secure, locked interengagment of lockable end 87 with housing 21 whenever desired, as well as providing an easily achieved, disengaged, unlocked configuration.

When leg 33 of shackle 22 is in its unlocked, open position, as shown in its entirety in FIG. 12, leg 33 of shackle 22 is in an upwardly, raised position, with end 34 of leg 33 positioned in zone 57 of bore 56, with end 34 of leg 33 of shackle 22 positioned away from interconnecting zone 107. When this open, unlocked position is attained, lockable end 87 of flexible cable assembly 85 is able to be freely inserted into and withdrawn from receiving bore 106 of housing 21. If locking means 108 is positioned in bore 106, terminating end portion 97 of lockable end 87 is able to dislodge locking means 108 from its position in bore 106, thereby enabling lockable end 87 to be freely inserted and withdrawn from receiving bore 106, as desired by the user.

Whenever secure, locked interengagment of end 87 with housing 21 is desired, lockable end 87 is inserted into receiving bore 106, and shackle 22 is moved from its open position to its closed position, as fully depicted in FIG. 13. This movement causes leg 33 of shackle 22 to move downwardly into zone 57 of bore 56, causing end 34 of leg 33 to contact locking means 108, forcing locking means 108 to move laterally in interconnecting zone 107 into contact with rod portion 96 of lockable end 87, as depicted in FIG. 18.

In the preferred construction, locking means 108 is dimensioned with a diameter greater than the length of interconnecting zone 107 in order to cause locking means 108 to extend into bore 106 when zone 57 is filled with leg 33 of shackle 22. Furthermore, with terminating end portion 97 having a diameter greater than rod portion 96, and receiving bore 106 having a depth which enables rod portion 96 to be aligned with interconnecting zone 107 when lockable end 87 is fully inserted into bore 106, the movement of shackle 22 into its locked position causes locking means 108 to blockingly engage lockable end 87, preventing the axial removal of locking end 87 from housing 21. As a result, when shackle 22 remains in its secure, locked position, lockable end 87 is also in secure, locked interengagement with housing 21.

Whenever the user desires to remove lockable end 87 from secure engagement with housing 21, dials 24 are rotated to display the preset combination, thereby enabling shackle 22 to be axially movable relative to housing 21, as previously detailed. Once the desired combination has been properly displayed, leg 33 of shackle 22 is axially moved upwardly, causing terminating end 34 of leg 33 to been removed from blocking engagement with interconnecting zone 107, as shown in FIG. 18, to the position depicted in FIG. 17.

When the fully unlocked position has been attained, terminating end 34 of leg 33 of shackle 22 is positioned above interconnecting zone 107, completely opening the interconnecting zone 107 with zone 57 of bore 56. Once this position has been attained, lockable end 87 is easily axially withdrawn from receiving bore 106, with terminating end portion 97 of lockable end 87 contacting locking means 108 and forcing locking means 108 to move laterally away from bore 106 and into alignment with zone 57 of bore 56. In this way, lockable end 87 is easily withdrawn from secure locked engagement with housing 21.

Figure 20:
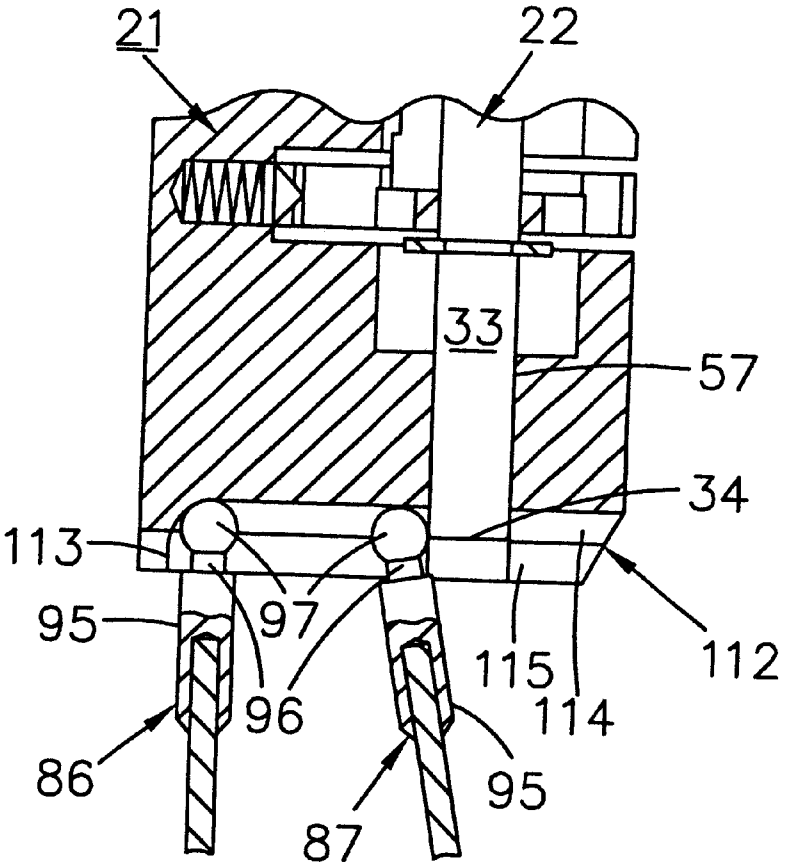
FIG. 20 is a front elevational view, mostly in cross-section and partially broken away, depicting the embodiment of the combination lock of FIG. 19 within the two separate and independent locking means shown in their fully locked positions.
Figure 19:
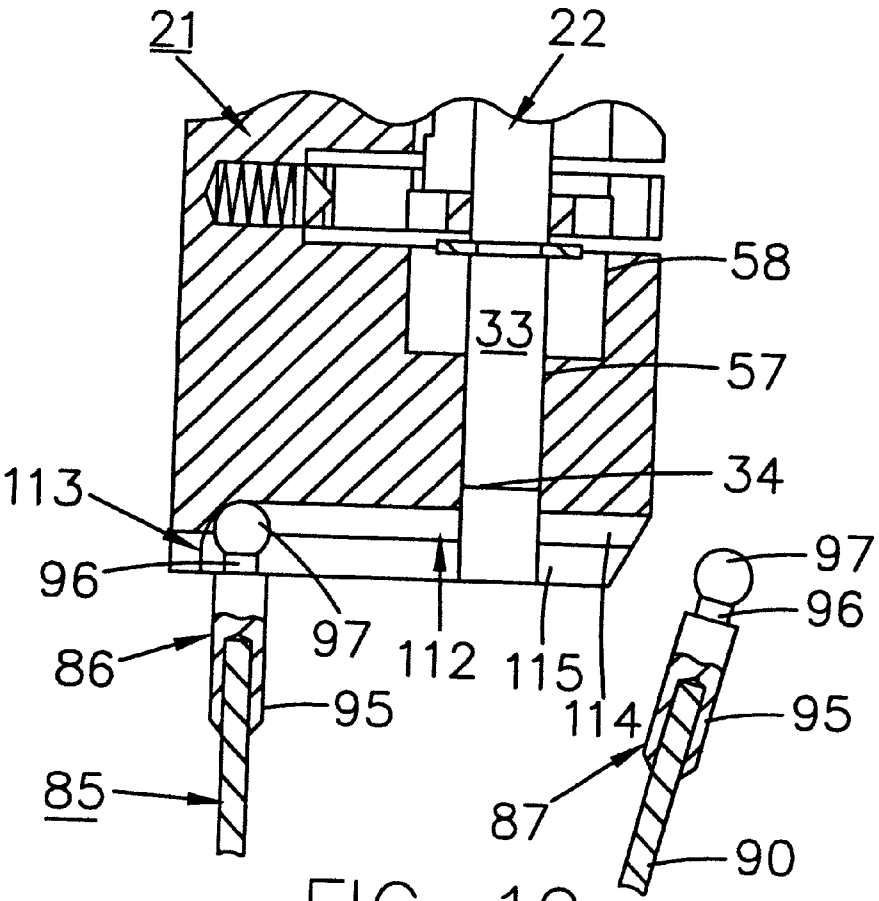
FIG. 19 is a front elevational view, mostly in cross-section and partially broken away, depicting a still further alternate embodiment of the combination lock of the present invention having two separate and independent locking means with both locking means shown in their unlocked position.
Figure 21:
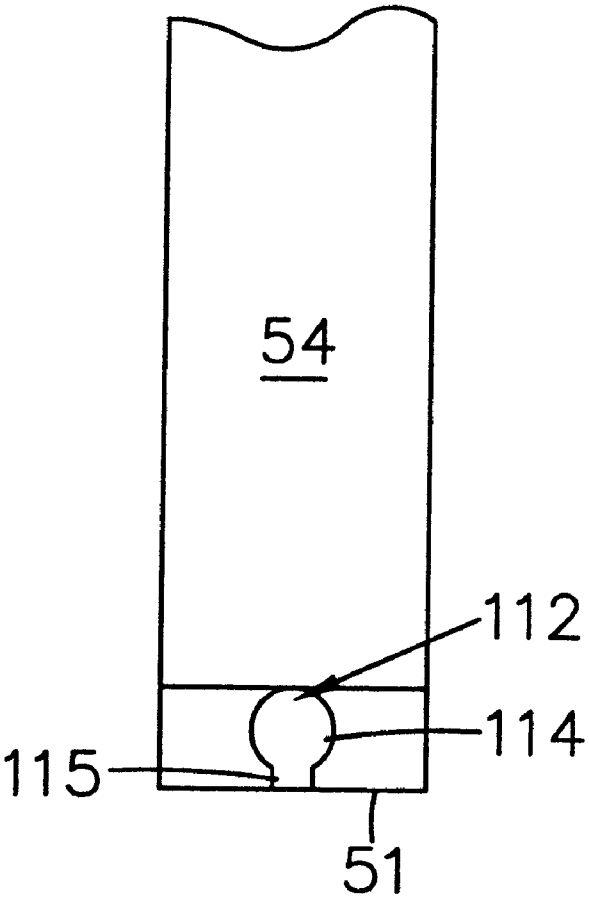
FIG. 21 is a side elevation view of the combination lock of FIG. 19 showing the entrance to the T-shaped holding zone formed therein.

FIGS. 19, 20, and 21 depict a still further alternate embodiment of combination lock 20 of the present invention, with two separate and independent locking means incorporated therein. By referring to these Figures, along with the following detailed discussion, the construction and operation of this further alternate embodiment for the secondary locking system can best be understood.

In this embodiment, housing 21 of lock 20 comprises an elongated T-shaped holding zone 112 formed in bottom surface 51 of housing 21. In the preferred construction, holding zone 112 is open along side edge 54 and extends from side edge 54, terminating directly adjacent side edge 55 with an abutment wall 113. In addition, in the preferred embodiment, holding zone 112 comprises an enlarged channel 114 and a narrow slot 115 which extends downwardly from channel 114 to bottom surface 51 of housing 21, forming an elongated open narrow slot therein. Finally, zone 57 of bore 56 of housing 21 preferably extends through T-shaped holding zone 112 to bottom surface 51 of housing 21.

As with the embodiments detailed above, the secondary locking means incorporated in combination lock 20 of this embodiment comprises flexible cable assembly 85. Furthermore, as detailed above, fixed end 86 of flexible cable assembly 85 may be secured to housing 21 in this embodiment in the identical manner detailed above in the three alternate embodiments. However, for exemplary purposes, FIGS. 19 and 20 depict flexible cable assembly 85 as being constructed for completely removable from housing 21. By employing this embodiment of the present invention, a consumer has the ability to employ combination lock 20 with shackle 22 as the only locking means, when so required, and in alternate situations, mount flexible cable assembly 85 to housing 21, as detailed below, in order to provide the secondary locking means, when so desired.

In this embodiment of the present invention, both fixed end 86 and lockable end 87 of flexible cable assembly 85 comprise substantially identical constructions, using cap 92 at both ends of cable member 90. As a result, both fixed end 86 and lockable end 87 comprise cylindrical body portions 95, rod portions 96, and terminating end portions 97. In addition, enlarged channel 114 is constructed with an overall width greater than the diameter of terminating end portion 97, while narrow slot 115 comprises a width greater than the diameter of rod portion 96 but smaller than the diameter of the terminating end portion 97. As a result, both fixed end 86 and lockable end 87 cannot be vertically removed from holding zone 112, due to the inability of terminating end portion 97 to pass through narrow slot 115.

By employing this construction, both fixed end 86 and lockable end 87 are easily inserted into T-shaped holding zone 112 along side surface 54, and advanced along the length of holding zone 112 whenever shackle 22 is in its raised, unlocked position, as depicted in FIG. 19. Since enlarged channel 114 is constructed for receiving terminating end portion 97, terminating end portions 97 of fixed end 86 and lockable end 87 are able to enter enlarged channel 114 and advance along the length thereof. Simultaneously therewith, rod portions 96 of fixed end 86 and lockable end 87 enter narrow slot 115 and advance along the length of slot 115.

As discussed above in regard to the other alternate embodiments of the present invention, when leg 33 of shackle 22 is in its unlocked, open position, as shown in its entirety in FIG. 12, leg 33 of shackle 22 is in an upwardly, raised position, with end 34 of leg 33 positioned above T-shaped holding zone 112. As a result, fixed end 86 and lockable end 87 of flexible cable assembly 85 are able to enter holding zone 112 and freely slide along the length thereof up to abutment wall 113.

Whenever secure, locked interengagement of flexible cable assembly 85 with housing 21 is desired, shackle 22 is moved from its open position to its closed position, as fully depicted in FIG. 13. This movement causes leg 33 of shackle 22 to move downwardly, with end 34 of leg 33 entering enlarged channel 114 of holding zone 112. As a result of this movement, lockable end 87 of flexible cable assembly 85 is captured between leg 33 of shackle 22 and abutment wall 113. As a result, lockable end 87 is incapable of being withdrawn from holding zone 112 and the desired secure locked engagement of flexible cable assembly 85 with housing 21 is attained.

Whenever the user desires to remove lockable end 87 from secure engagement with housing 21, dials 24 are rotated to display the pre-set combination, thereby enabling shackle 22 to be axially movable relative to housing 21, as previously detailed. Once the desired combination has been properly displayed, leg 33 of shackle 22 is axially moved upwardly, causing terminating end 34 of leg 33 to be removed from blocking engagement in enlarged channel 114, as shown in FIG. 20, to the position depicted in FIG. 19, where lockable end 87 and fixed end 86 of flexible cable assembly 85 are free to slide the entire length of holding zone 112 and enable any product secured thereby to be released.

If desired, combination lock 20 of the present invention may incorporate a plurality of sets of pins 41 and springs 42, which are mounted in a receiving cavity formed in housing 21. Although these components are optional, the preferred embodiment incorporates one pin and spring in direct association with each rotatable dial 24 in order to provide positive position locating means which also produces an audible sound each time the precise position of each numeral on dial 24 is reached.

In the preferred construction, each spring 42 is maintained under compression, forcing each pin 41 into engagement with outer surface 44 of dial member 24. In addition, with each dial member incorporating slots 46 formed between each numeral bearing panel 45, the movement of spring loaded pin 41 into and out of slots 46 causes an audible click, designating the proper orientation of the dial for each numeral. In addition to the audible click produced, the movement of pin 41 into engagement in slot 46 also provides a positive structural indication and rotational stop indicating that one particular numeral is in its proper orientation.

One of the difficulties encountered with prior art combination locks is the ability of some individuals to gain access to a secured lock by using known picking techniques. The principal technique employed is to apply pressure to the shackle while individually rotating the dials and. listening for a known clicking sound which occurs whenever the locking fin or bar of the tumbler sleeve enters the release channel associated with that tumbler. By continuously repeating this process, a secured lock is capable of being unlocked even though the individual does not know the actual combination for that lock.

In order to virtually eliminate the ability of the combination lock of the present invention to be picked, housing 21 incorporates a plurality of recess slots 66 formed about elongated central bore 56 in an arcuate, juxtaposed, spaced relationship relative to release channel 60. In the preferred embodiment, three recess slots 66 are formed about zone 58 of central bore 56 at approximately 90° from each other on each wall 62 of each dial receiving zone 61.

In this way, each dial and each tumbler sleeve is directly associated with three separate and independent recess slots 66 in order to assure that false clicking of position locating sounds are produced whenever each dial is rotated. As best seen by the uppermost tumbler sleeve 23 and dial 24 of FIG. 2, when lock 20 is in its secured and locked position, the rotation of dial 24 about leg 33 of shackle 22 also causes tumbler sleeve 23 to rotate, since fin 25 is captured in one slot 30 of dial 24. If an unauthorized person attempts to pick combination lock 20, seeking to hear the clicking sound made when each fin 25 enters release channel 60, the individual will be thwarted, since a plurality of false clicks will be produced for each tumbler sleeve 23 and dial 24.

In the present invention, whenever tumbler sleeve 23 and dial 24 are rotated with axial pressure placed on shackle 22 to pick lock 20, fin 25 rotationally moves along upper surface 62 of dial receiving slot 61 until fin 25 enters one of the slots 66 formed in surface 62. Upon entering a slot 66, a clicking noise is produced which simulates the noise produced when fin 25 enters release channel 60.

Since three separate recess slots 66 are formed on each surface 62 of each dial receiving slot 61 (FIG. 6), each tumbler sleeve/dial combination produces four clicks, only one of which represents the actual entry of fin 25 into channel 60. As a result, the easy and quick picking procedure attainable with most prior art constructions is eliminated, and a virtually pick-free structure is realized.

As is evident from the foregoing detailed disclosure, by employing the present invention, a uniquely constructed combination lock is attained which provides all of the desired functions of a combination lock in a highly effective, easily assembled and easily employed construction capable of being produced with substantially greater ease and convenience. Furthermore, the construction of the present invention incorporates a positive visual indicator to the user whenever the lock is placed in its combination setting or re-setting position, thereby enhancing the use and personalization provided by the present invention.

In addition, the combination lock of the present invention incorporates a virtually sealed construction which eliminates unwanted debris from entering the rotating mechanisms of the combination lock. As a result, interference of these rotating components with environmental debris is virtually eliminated and a combination lock is attained which is capable of providing long-term use, free from interference or destruction by environmental contamination.

In addition to employing the present construction detailed above, the present invention can also be implemented using alternate design features. One such feature easily employed in the present invention without deviating from the scope of the present invention would be the elimination of rib 39 and the incorporation of a radially extending ledge in leg 33 of shackle 22 to define the stop position for washer 35. In addition, washer 35 may comprise a ledge or diameter so as to prevent the entry of washer into the cavity formed by inside surface 76 of cap 37. In this way, the axial movement of shackle 22 upwardly would be limited by the contact of washer 35 with the base of cap 37.

These variations, as well as other variations, can be incorporated into combination lock 20 of the present invention without departing from the scope of the present invention. Consequently, it is intended that all such variations form a part of this invention and are within the scope of this invention.

Figure 22:
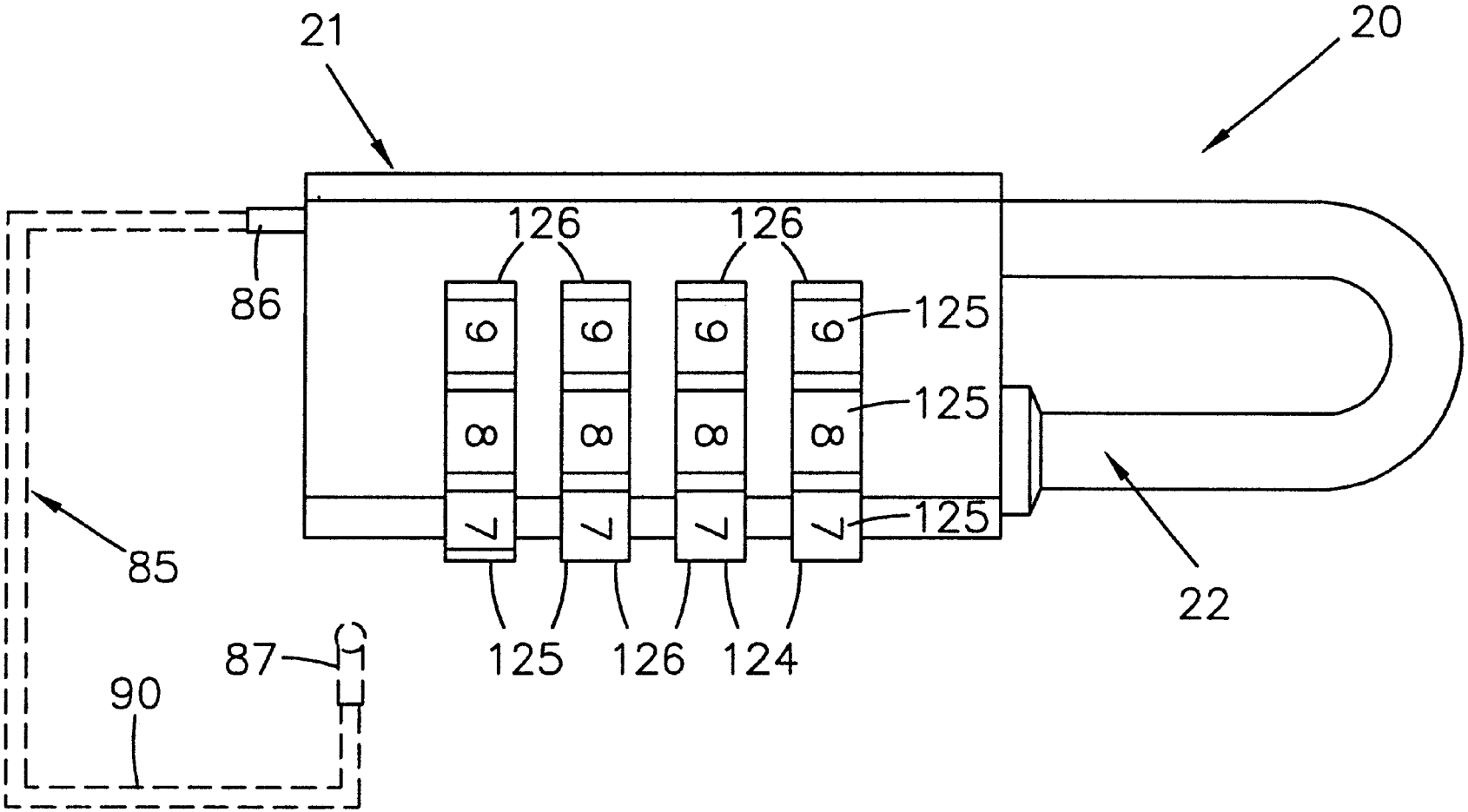
FIG. 22 is a front elevation view of a further embodiment of the present invention.

Finally, in FIG. 22, a further alternate embodiment of the present invention is depicted. In this embodiment, combination lock 20 comprises a housing 21 and a shackle 22 which are constructed in a manner substantially identical to the construction detailed above, incorporating any of the features defined above. In this embodiment, however, the unique and distinctive new element which is incorporated into lock 20 is the construction of rotatable dials 124.

As detailed above, lock 20 comprises a plurality of dials 124 which are employed to enable the user to select and repeatedly. enter any desired combination for opening of the lock, whenever desired by the user. In this regard, many individuals have experienced difficulty in reading the indicia printed on prior art dials and, as a result, have had difficulty in opening prior art locks. In order to eliminate this continuing difficulty, this embodiment of the present invention incorporates rotatable dials 124 which are constructed substantially larger than conventional prior art dials.

In this regard, dials 124 comprise a plurality of panels 126 which are substantially greater in size and dimension than prior art panels with indicia 125 printed on each panel 126 which also is substantially larger than prior art constructions. As a result, consumers are capable of easily seeing indicia 125 as printed on panels 126 of dials 124 and are capable of setting the combination quickly and easily without any difficulty.

In the preferred embodiment, dials 124 incorporate any desired indicia 125, preferably in the form of numerals printed on the plurality of panels 126 formed in dials 124. As detailed above, the preferred construction employs ten separate and distinct panels 126 formed on each dial 124, with indicia 125 sequentially ranging from 0 to 9 printed thereon or formed therein.

In addition, in the preferred embodiment, each indicia 125 is constructed with a size ranging between about 15% and 50% greater than the size conventionally employed for prior art indicia. In order to accommodate this increased dimensional, readily visible, visually distinctive construction, each panel 126 and each dial 124 preferably comprises a dimension greater than prior art panels and dials which range between about 15% and 50%.

By employing this construction, combination lock 20 is realized which is capable of being easily used by any individual regardless of vision impairments or visual difficulties. In this way, individuals are capable of quickly and easily rotating dials 124 to display the precisely desired preselected combination for enabling lock 20 to be opened.

In addition, as depicted in FIG. 22, combination lock 20 may also incorporate secondary locking means in the form of flexible cable assembly 85. As detailed above, flexible cable assembly 85 preferably comprises a fixed end 86, a lockable end 87, and elongated, substantially continuous cable member 90. By employing this added feature in lock 20, individuals with impaired vision are capable of enjoying the benefits of both a lockable shackle, as well as a lockable cable assembly.

It will thus be seen that the objects set forth above, among those made apparent from the preceding description are efficiently attained and, since certain changes may be made in the above article without departing from the scope of this invention, it is intended that all matter contained in this disclosure or shown in the accompanying drawings, shall be interpreted as illustrative and not in a limiting sense.

It is also to be understood that the following claims are intended to cover all of the generic and specific features of the invention herein described and all statements of the scope of the invention which as a matter of language, might be said to fall therebetween.

Having described my invention, what I claim as new and desire to secure by Letters Patent is:

1. A combination lock constructed for providing two separate and independent locking means, said combination lock comprising:

A. a housing incorporating
  a. an elongated bore,
  b. a plurality of dial receiving zones formed in the housing, and
  c. an elongated release channel formed in the elongated bore and axially extending therewith, said elongated release channel defining a zone for enabling the opening of the combination lock;

B. first locking means in the form of a shackle comprising a generally J-shape, incorporating
  a. a short leg having a terminating end constructed for cooperative locking and unlocking interengagement with the housing, and
  b. a long leg cooperatively mounted in the elongated central bore of the housing for axial movement and pivoting movement relative thereto;

C. a plurality of tumbler sleeves, each of said tumbler sleeves
  a. rotationally mounted to the long leg of the shackle for rotational movement about the central axis thereof, and
  b. incorporating a radially extending fin formed on the outside surface thereof and constructed for cooperative association with the elongated release channel for preventing axial movement of the long leg of the shackle as well as enabling axial movement thereof when each of said radial fins are positioned in the elongated release channel;

D. a plurality of dials each of said dials
  a. mounted in a dial receiving zone of the housing, and
  b. peripherally surrounding a tumbler sleeve for cooperating therewith; and E. second locking means in the form of a flexible cable assembly comprising
  a. an elongated, substantially continuous cable member having a first end and a second end,
  b. said first end being securely mountable to the housing, and
  c. said second end being removably lockable to the housing in cooperating relationship with the long leg of the shackle and the axial movement of the shackle relative to the housing, whereby a combination lock is attained having two separate and independent locking means with each being securable to the housing whenever desired by the user.

2. A combination lock constructed for providing two separate and independent locking means, said combination lock comprising:

A. a housing incorporating
  a. an elongated bore,
  b. a plurality of dial receiving zones formed in the housing, each of said receiving zones
    1. extending substantially perpendicularly to the axis of the central bore, and
    2. defined by two juxtaposed, spaced, parallel facing surfaces, each of said surfaces extending perpendicularly to the central axis of the central bore; and
  c. an elongated release channel formed in the elongated bore and axially extending therewith, said elongated release channel defining a zone for enabling the opening of the combination lock;

B. first locking means in the form of a shackle comprising a generally J-shape, incorporating
  a. a short leg having a terminating end constructed for cooperative locking and unlocking interengagement with the housing, and
  b. a long leg cooperatively mounted in the elongated central bore of the housing for axial movement and pivoting movement relative thereto;

C. a plurality of tumbler sleeves, each of said tumbler sleeves
  a. rotationally mounted to the long leg of the shackle for rotational movement about the central axis thereof, and
  b. incorporating a radially extending fin formed on the outside surface thereof and constructed for cooperative association with the elongated release channel and the parallel, facing surfaces of the dial-receiving zone for preventing axial movement of the long leg of the shackle as well as enabling axial movement thereof when each of said radial fins are positioned in the elongated release channel;

D. a plurality of dials each of said dials
  a. mounted in a dial receiving zone of the housing,
  b. peripherally surrounding a tumbler sleeve for cooperating therewith, and
  c. comprising an inside surface formed by the tumbler locking surface and a tumbler release surface; and E. second locking means in the form of a flexible cable assembly comprising
  a. an elongated, substantially continuous cable member having a first end and a second end,
  b. said first end being securely mountable to the housing, and
  c. said second end being removably lockable to the housing in cooperating relationship with the long leg of the shackle and the axial movement of the shackle relative to the housing, whereby a combination lock is attained having two separate and independent locking means with each being securable to the housing whenever desired by the user.

3. The combination lock defined in claim 2, wherein said cable member is further defined as comprising material resistant to being broken or severed.

4. The combination lock defined in claim 3, wherein said cable member is further defined as being formed from braided or woven wire fibers.

5. The combination lock defined in claim 2, wherein said first end is further defined as means securely anchored to the housing.

6. The combination lock defined in claim 5, wherein said housing is further defined as comprising a first end receiving bore for securely holding and affixing the first end of the flexible cable assembly therein.

7. The combination lock defined in claim 6, wherein anchor means are mounted between the housing and the first end of the flexible cable assembly in cooperating association with the first end receiving bore for securely maintaining and affixing the first end of the flexible cable assembly to the housing.

8. The combination lock defined in claim 5, wherein the long leg of the shackle comprises a terminating end and is positioned in the elongated bore for controlled axial movement therein between a first unlocked, raised position and a second, locked, lowered position.

9. The combination lock defined in claim 8, wherein the housing further comprises a second end receiving bore formed therein in cooperating relationship with the central bore of the housing, said second end receiving bore being positioned for enabling the axial movement of the shackle to cooperate therewith.

10. The combination lock defined in claim 9, wherein the second end of the flexible cable assembly is further defined as comprising a body portion securely affixed to the second end of the cable assembly and incorporating a reduced width zone formed therein along the length thereof.

11. The combination lock defined in claim 10, wherein the second end receiving bore is further defined as being formed perpendicularly to the elongated bore and intersecting therewith, enabling the second end of the flexible cable assembly to enter the second end receiving bore with the reduced thickness zone aligned with the elongated bore, positioned for mating, locking interengagement with the terminating end of the long leg of the shackle, whereby movement of the shackle into its second position securely locks the second end of the flexible cable assembly in the second end receiving bore, while movement of the shackle into its first position enables the second end of the flexible cable assembly to be telescopically inserted and withdrawn from the second end receiving bore.

12. The combination lock defined in claim 10, wherein the second end receiving bore is further defined as being formed in the base of the housing coaxially aligned with the elongated bore and cooperatively associated with a slot formed in the base of the housing diametrically extending from the second end receiving bore and comprising a width greater than the width of the reduced width zone of the second end but less than the width of the body portion of the second end, with said housing also incorporating an enlarged cavity formed above said slot and communicating with said second end receiving bore, whereby the second end of the flexible cable assembly is able to telescopically enter the second end receiving bore when the shaft is in its first, unlocked raised position and move therefrom into cooperating engagement with the slot and enlarged cavity, while also being lockingly captured in said slot and enlarged cavity whenever the end of the long leg of the shackle is moved into its second, locked position, effectively blocking the enlarged cavity and capturing the second end therein.

13. The combination lock defined in claim 10, wherein said second end receiving bore is further defined as being formed in the base of the housing with its longitudinal axis being offset and parallel to the elongated axis of the housing, and said housing also incorporates an interconnecting zone extending between and communicating with said second end receiving zone and said elongated bore, and further comprising a locking member mounted in said interconnecting zone and movable between said elongated bore and said second end receiving bore in response to the movement of the long leg of the shackle between its first unlocked position and its second locked position.

14. The combination lock defined in claim 10, wherein said housing further comprises a T-shaped holding zone formed along the bottom surface of the housing in cooperating relationship with the elongated bore of the housing for enabling the terminating end of the long leg of the shackle to move into and out of blocking engagement of said holding zone in response to the movement of the shackle between its first unlocked position and its second locked position, and said T-shaped holding zone being dimensioned for receiving and holdingly capturing the reduced width zone of the second end of the flexible cable assembly and securely maintaining the second end of the cable assembly therein whenever the shackle is in its second locked position.

15. The combination lock defined in claim 14, wherein both the first end and the second end of the flexible cable assembly are slidingly engaged and lockingly retained in said T-shaped holding zone in response to movement of the shackle between its two alternate positions.

16. The combination lock defined in claim 2, wherein the dial is further defined as comprising a generally cylindrical shape having a plurality of indicia bearing panels on an outer surface thereof for establishing readily identifiable indicia which define elements usable as the combination for defining the release mode of the lock.

17. The combination lock defined in claim 16, wherein each of the dials are further defined as comprising substantially enlarged indicia bearing panels and substantially enlarged indicia formed thereon, enabling individuals with vision impairments to easily see the indicia on said indicia bearing panels.

18. The combination lock defined in claim 17, wherein each indicia bearing panel and each indicia formed therein comprises an overall dimension ranging between about 15% and 40% greater than the like dimension of conventional indicia and indicia bearing panels.

19. A combination lock constructed for providing two separate and independent locking means, said combination lock comprising:

A. a housing incorporating
   a. an elongated bore,
   b. a plurality of dial receiving zones formed in the housing, and
   c. an elongated release channel formed in the elongated bore and axially extending therewith, said elongated release channel defining a zone for enabling the opening of the combination lock;

B. first locking means in the form of a shackle comprising a generally J-shape, incorporating
   a. a short leg having a terminating end constructed for cooperative locking and unlocking interengagement with the housing, and
   b. a long leg cooperatively mounted in the elongated central bore of the housing for axial movement and pivoting movement relative thereto;

C. a plurality of tumbler sleeves, each of said tumbler sleeves
   a. rotationally mounted to the long leg of the shackle for rotational movement about the central axis thereof, and
   b. incorporating a radially extending fin formed on the outside surface thereof and constructed for cooperative association with the elongated release channel for preventing axial movement of the long leg of the shackle as well as enabling axial movement thereof when each of said radial fins are positioned in the elongated release channel; and D. a plurality of dials each of said dials
   a. mounted in a dial receiving zone of the housing,
   b. peripherally surrounding a tumbler sleeve for cooperating therewith, and
   c. comprising a generally cylindrical shape having a plurality of enlarged indicia bearing panels on an outer surface thereof and an enlarged indicia formed in each of said panels, each of said enlarged indicia and enlarged panels comprising an overall dimension ranging between about 15% and 50% greater than the dimension of conventional indicia and indicia bearing panels;

E. second locking means in the form of a flexible cable assembly comprising
   a. an elongated, substantially continuous cable member having a first end and a second end,
   b. said first end being securely mountable to the housing, and
   c. said second end being removably lockable to the housing in cooperating relationship with the long leg of the shackle and the axial movement of the shackled relative to the housing, whereby a combination lock is attained having two separate and independent locking means with each being securable to the housing whenever desired by the user.

* * * * *